US007184018B2

(12) United States Patent
Makino et al.

(10) Patent No.: US 7,184,018 B2
(45) Date of Patent: Feb. 27, 2007

(54) LIQUID CRYSTAL DISPLAY DEVICE AND LIQUID CRYSTAL DISPLAY METHOD

(75) Inventors: Tetsuya Makino, Kawasaki (JP); Toshiaki Yoshihara, Kawasaki (JP); Hironori Shiroto, Kawasaki (JP); Yoshinori Kiyota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 568 days.

(21) Appl. No.: 09/772,762

(22) Filed: Jan. 30, 2001

(65) Prior Publication Data

US 2002/0008683 A1 Jan. 24, 2002

(30) Foreign Application Priority Data

May 30, 2000 (JP) ..... 2000-161052

(51) Int. Cl.
*G09G 3/36* (2006.01)

(52) U.S. Cl. ..... 345/102; 345/88

(58) Field of Classification Search ..... 345/87–89, 345/98–100, 102, 204

See application file for complete search history.

(56) References Cited

U.S. PATENT DOCUMENTS 4,212,010 A * 7/1980 Walter ..... 345/95
4,380,008 A * 4/1983 Kawakami et al. ..... 345/94
4,915,477 A * 4/1990 Ohta et al. ..... 345/94
5,216,415 A * 6/1993 Ono et al. ..... 345/94
5,353,041 A * 10/1994 Miyamoto et al. ..... 345/97
5,412,397 A * 5/1995 Kanatani et al. ..... 345/99
5,559,616 A * 9/1996 Kanbe et al. ..... 349/36
5,731,794 A * 3/1998 Miyazawa ..... 345/88
6,069,600 A * 5/2000 Saishu et al. ..... 345/87
6,115,016 A * 9/2000 Yoshihara et al. ..... 345/88
6,392,620 B1 * 5/2002 Mizutani et al. ..... 345/88
6,476,784 B2 * 11/2002 Zavracky et al. ..... 345/88
6,570,554 B1 * 5/2003 Makino et al. ..... 345/102
2002/0000960 A1 * 1/2002 Yoshihara et al. ..... 345/87

FOREIGN PATENT DOCUMENTS

JP 53-061221 6/1978
JP 04-044478 2/1992
JP 04-186217 7/1992
JP 05-080717 4/1993
JP 08-500915 1/1996

(Continued)

*Primary Examiner*—Regina Liang
(74) *Attorney, Agent, or Firm*—Greer, Burns & Crain, Ltd.

(57) ABSTRACT

In a liquid crystal display device which is constructed by sealing a liquid crystal having spontaneous polarization in an active matrix panel including a coloring member and displays an image on a frame by frame basis by repeating a data writing process and a data erasing process for the active matrix panel, the frequency in the data writing process is set at least twice higher than a frame frequency and the data writing process and the data erasing process are completed within one frame time so that time taken for transmission of light through the coloring member is not more than a half of one frame time. The coloring member is in a non-light-transmitting state during a period of not shorter than a half of one frame, and the blurred outline section of a moving image is reduced.

2 Claims, 38 Drawing Sheets

FOREIGN PATENT DOCUMENTS

| | | |
|---|---|---|
| JP | 11-237606 | 8/1999 |
| JP | 2000-019486 | 1/2000 |
| JP | 2000-206492 | 7/2000 |
| JP | 2000-338464 | 12/2000 |
| WO | WO 95/01701 | 1/1995 |

* cited by examiner

LIQUID CRYSTAL DISPLAY DEVICE AND LIQUID CRYSTAL DISPLAY METHOD

BACKGROUND OF THE INVENTION

The present invention relates to a liquid crystal display device and liquid crystal display method, and more specifically to a color liquid crystal display device and color liquid crystal display method using a liquid crystal having spontaneous polarization.

The liquid crystal display devices are mainly classified into the reflection type and the transmission type. In the reflection type liquid crystal display devices, light rays incident on the front face of a liquid crystal panel are reflected by the rear face of the liquid crystal panel so that an image is visualized by the reflected light. In the transmission type liquid crystal display devices, an image is visualized by transmitted light from a light source (back-light) provided on the rear face of the liquid crystal panel. Although the reflection type liquid crystal display devices have poor visibility resulting from the reflected light amount varying depending on environmental conditions, they have been widely used as monochrome (such as black and white) display devices for portable calculators, watches, etc. because of their low costs. However, they are not suitable as display devices of personal computers displaying a multi-color or full-color image. For this reason, in general, transmission type liquid crystal display devices are used as display devices of personal computers displaying a multi-color or full-color image.

In addition, currently-used color liquid crystal display devices are generally classified into the STN (Super Twisted Nematic) type and the TFT-TN (Thin Film Transistor-Twisted Nematic) type based on the liquid crystal materials to be used. The STN type liquid crystal display devices have comparatively low production costs, but they are not suitable for the display of a moving image because they are susceptible to crosstalk and comparatively slow in the response rate. In contrast, the TFT-TN type liquid crystal display devices have better display quality than the STN type, but they require a back-light with high intensity because the transmissivity of the liquid crystal panel is only 4% or so at present. For this reason, in the TFT-TN type liquid crystal display devices, a lot of power is consumed by the back-light, and there would be a problem when used with a battery power source. Moreover, the TFT-TN type liquid crystal display devices have other problems including a low response rate, particularly in displaying half tones, a narrow viewing angle, and a difficult color balance adjustment.

Under such circumstances, in the case where a liquid crystal display device is used as a multi-media display device, it is required to have a moving image display characteristic capable of displaying a full moving image. With the currently-used liquid crystal display devices, however, even if images are displayed at a high rate, the liquid crystal display device reaches its limit in displaying around 40 images per second. If full moving images are displayed at a higher rate, for example, at a rate of 60 images per second, the liquid crystal molecules can not act sufficiently, resulting in blurred images.

In order to solve such a problem, it has been known to use a liquid crystal material having spontaneous polarization capable of responding at a rate of several tens to several hundreds μ seconds, for example, ferroelectric liquid crystal material or antiferroelectric liquid crystal material. In a liquid crystal display device using a liquid crystal material having such spontaneous polarization, a passive type panel (simple matrix panel) is usually used. However, in this simple matrix type, since writing of each line is carried out until the liquid crystal molecules have come to a completely still state, it takes 16.6 milliseconds (1/60 second) or more to display one image and consequently a full moving image display can not be achieved. Therefore, an active matrix panel, namely a TFT panel is used. With the use of the TFT panel, even when a drive voltage application time per line is shorter than the response time of liquid crystal molecules, the liquid crystal molecules act due to charges introduced into the TFT. Besides, if the liquid crystal molecules show a sufficient response before the next application of a drive voltage, a full moving image display can be achieved without problems. Furthermore, with the use of the TFT panel, it is possible to readily control half-tone display.

As described above, with a color liquid crystal display device constructed by sealing a coloring material, such as a color filter, and ferroelectric liquid crystal material or antiferroelectric liquid crystal material in a TFT panel, it is possible to achieve a full moving image display compatible with multimedia. However, in the event where this full moving image display is observed in detail, when a displayed image is moved, the outline portion of the image along a direction perpendicular to the moving direction is seen as a blur. Moreover, as the moving speed increases, the blur of the outline portion becomes more noticeable, resulting in degradation of the image quality. Such a phenomenon can be explained by the following theory.

FIG. 1 is a schematic diagram showing a basic image which is used for the purpose of explaining the theory. As shown in FIG. 1, this basic image is a white square image with a black background. In the case where the basic image as shown in FIG. 1 is displayed as a still image, since the image is fixed, the square image can be observed clearly.

Next, display of a moving image will be considered. Here, for a display of this white square image as a moving image, suppose that this image moves in the right direction at a constant rate (for example, three pixels/frame). FIG. 2 is an illustration showing the pixel position in each frame during the display of moving image. In FIG. 2, the vertical axis is a time axis, while the horizontal axis indicates pixels on a certain line on a liquid crystal panel. Here, the moving image is displayed on the liquid crystal panel in such a manner that the image having a black background and a white portion in the width of four pixels moves by an amount of three pixels per frame in a direction in which the pixel number increases. Thus, as shown in FIG. 2, in the n frame, R, G, B display data are displayed from the m pixel to the m+3 pixel, and in the n+1 frame, similarly, R, G, B display data are displayed from the m+3 pixel to the m+6 pixel.

When observing such a moving image, the observer views the image while moving his/her eyes as the image moves. Therefore, as shown by arrow A in FIG. 2, the point at which the observer's eyes are turned moves by an amount of three pixels per frame in the image moving direction. The reason why the observer moves his/her eyes in such a manner when observing the moving image is to cause the moving image to always stay in the same position on the retina of the observer. Consequently, the observer recognizes an image as shown in FIG. 3.

FIG. 3 is an illustration showing an image state when a moving image display is viewed. In FIG. 3, similarly to FIG. 2, the vertical axis is the time axis, while the horizontal axis indicates the pixels on a certain line on the liquid crystal panel. Moreover, an image that is actually recognized by the observer (the observation result) is shown on the lower side of FIG. 3, which indicates that the higher the pitch of the slanting lines, the darker the image recognized. Furthermore, arrow A corresponds to the arrow A shown in FIG. 2, and indicates the movement of the point at which the observer's eyes are turned. In the case where a moving image is displayed, the eyes follow the target moving image. For instance, when the moving image is viewed by focusing the observer's eyes on the outline portion shown by the arrow A, since the target moving image is seen as if it is a still image on the retina, the displayed image of FIG. 2 is seen as if it is the observation result shown in FIG. 3 on the retina.

Since the point at which the observer's eyes are turned moves with a movement of the image, the displayed R, G, B display data are observed as if they are flowing in the direction opposite to the moving direction of that point (the direction in which the pixel number decreases). In other words, the R. G, B display data are observed as if they are drugged in the direction in which the pixel number decreases. In the case where the moving image is observed in such a manner, since the R, G, B display data are separated from each other in a time direction, degradation of the image quality of the outline portion is observed as shown in FIG. 3. More specifically, although the white image is displayed, the outline portion of the image is observed as a dark blur.

As described above, the outline portion of the image which is clearly displayed as a still image is seen as a blur as shown in FIG. 3 by following the moving image, and the outline portion is observed over several pixels. Hence, when this display device is used as a multimedia display device for displaying moving images, it causes a problem that degradation of the image quality occurs in displaying moving images.

FIGS. 2 and 3 schematically illustrate the state, and, in actual, since the pixel pitch is small, the outline portion of a moving image is not seen as a blur at a rate of around 3 dots per frame. However, when an image moves at an extremely high rate and the human's eyes can follow the moving image, degradation of the image quality as shown in FIG. 3 will be observed.

BRIEF SUMMARY OF THE INVENTION

An object of the present invention is to provide a liquid crystal display device and a liquid crystal display method, capable of reducing such image quality degradation that the outline portion of a displayed moving image is seen as a blur and thereby displaying a full image with limited degradation of the image quality.

A liquid crystal display device of the first aspect of the present invention is constructed by sealing a liquid crystal having spontaneous polarization in an active matrix panel including a coloring member, displays an image on a frame by frame basis by repeating a data writing process and a data erasing process for the active matrix panel, controls the frequency in the data writing process to be at least twice higher than a frame frequency and controls the data writing process and the data erasing process to be completed within one frame time so that time taken for transmission of light through the coloring member is not more than a half of one frame time.

In the liquid crystal display device of the first aspect, by setting the frequency in the data writing process for the active matrix panel at least twice higher than the frame frequency (not to be lower than 120 Hz) and completing the data writing process and the data erasing process for the active matrix panel within one frame time, time taken for transmission of light through the coloring member is made no more than a half of one frame time. Hence, the coloring member is in a non-light-transmitting state in a period of not shorter than a half of one frame, and the blurred outline section of a moving image is reduced compared with a conventional example, thereby reducing degradation of the image quality.

A liquid crystal display device of the second aspect of the present invention is based on the first aspect, and performs the data writing process and the data erasing process by using the entire one frame time.

Accordingly, upon the completion of the data writing process in one frame, the data erasing process is started, and upon the completion of this data erasing process, the data writing process for the next frame is started, thereby making it possible to readily control the data writing process and the data erasing process.

A liquid crystal display device of the third aspect of the present invention is based on the first aspect, and provides a period during which neither the data writing process nor the data erasing process is performed. Accordingly, time taken for transmission of light through the coloring member is further shortened and degradation of the image quality is further reduced, thereby achieving a further improvement in the image quality.

A liquid crystal display device of the fourth aspect of the present invention is based on any one of the first through third aspects, and comprises a back-light for irradiating white light on the coloring member and a back-light controller for controlling the back-light to be turned on or off according to the data writing process and the data erasing process. Since the liquid crystal display device of the fourth aspect controls the back-light as a light source to be turned on or off according to the data writing process and the data erasing process, the back-light is turned on only in a necessary period so as to reduce the consumption of power.

The above and further objects and features of the invention will more fully be apparent from the following detailed description with accompanying drawings.

DETAILED DESCRIPTION OF THE INVENTION

The following description will explain the present invention with reference to the drawings illustrating the embodiments thereof.

Figure 4:
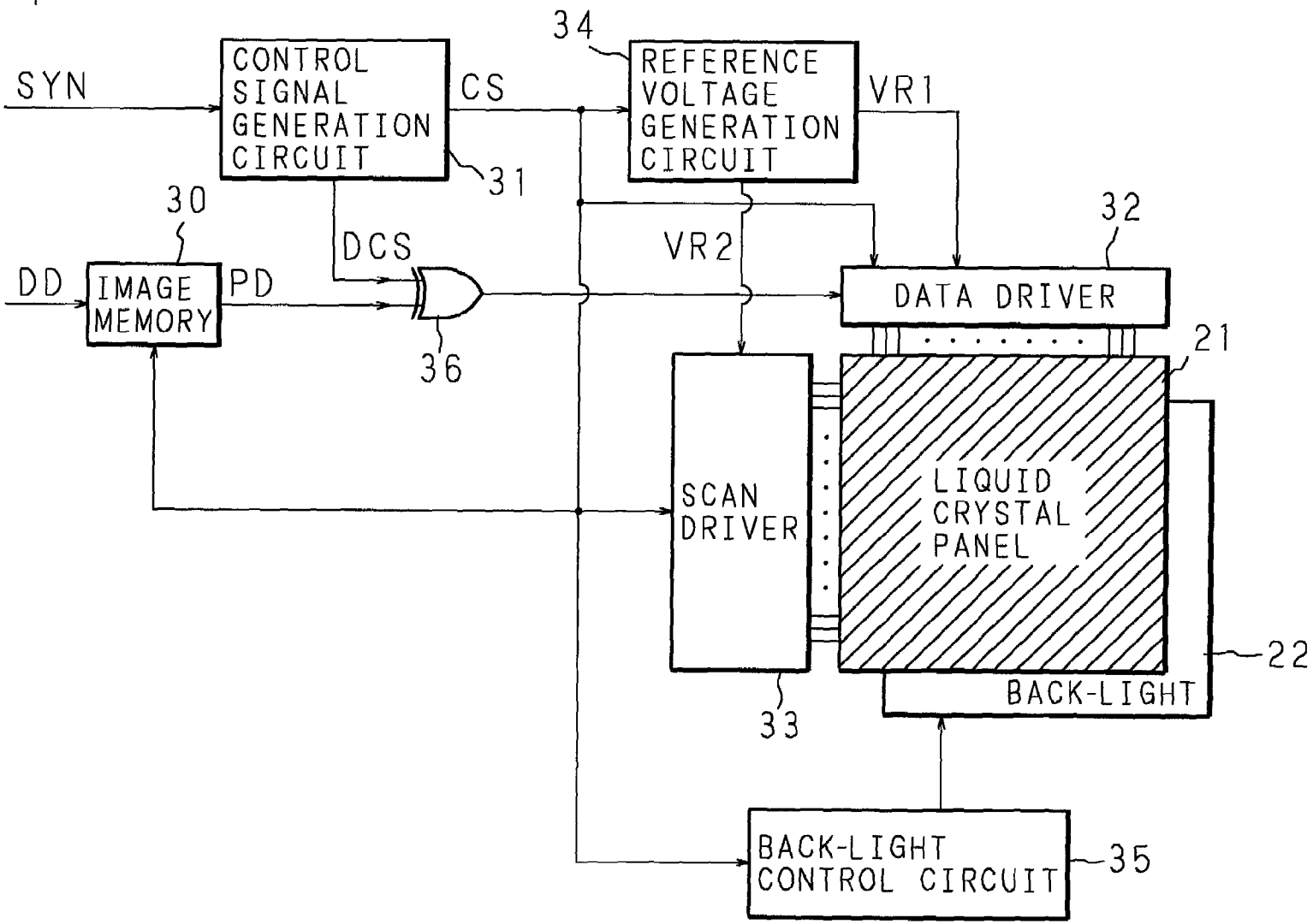
FIG. 4 is a block diagram showing the circuit structure of a liquid crystal display device of the present invention.
Figure 5:
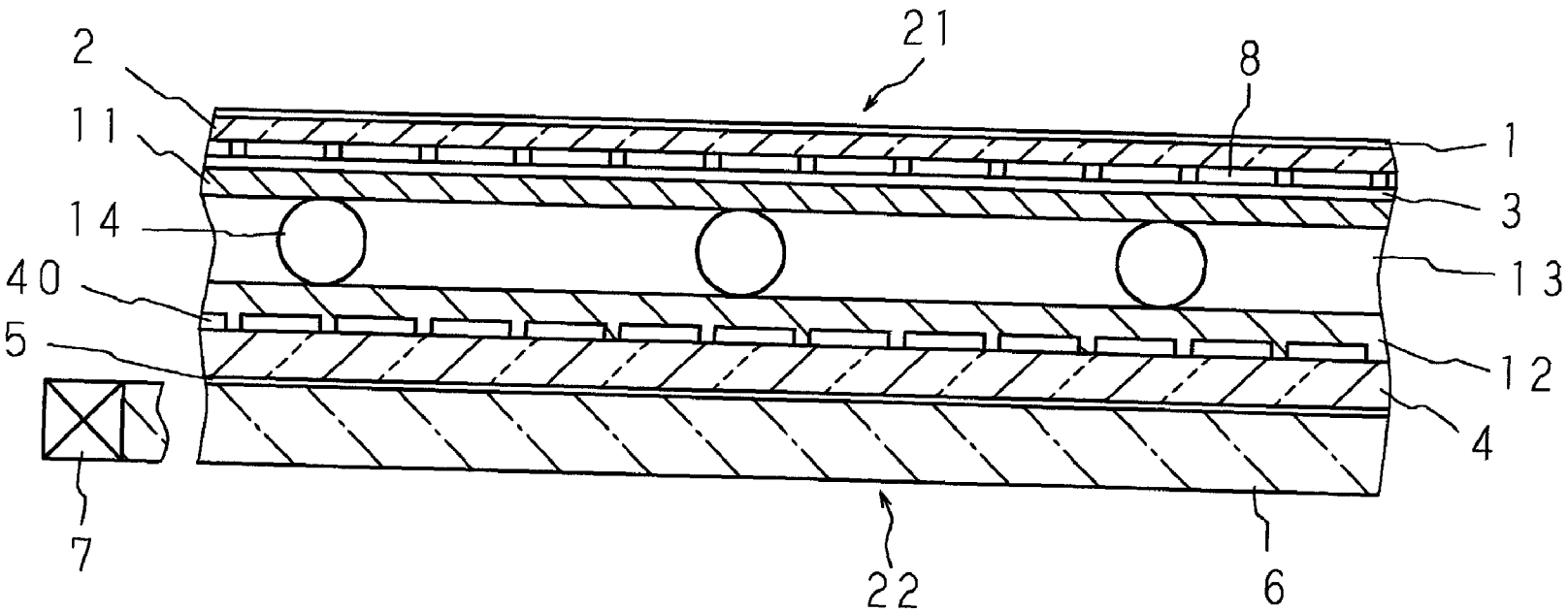
FIG. 5 is a schematic cross sectional view of a liquid crystal panel and back-light of the liquid crystal display device of the present invention.
Figure 6:
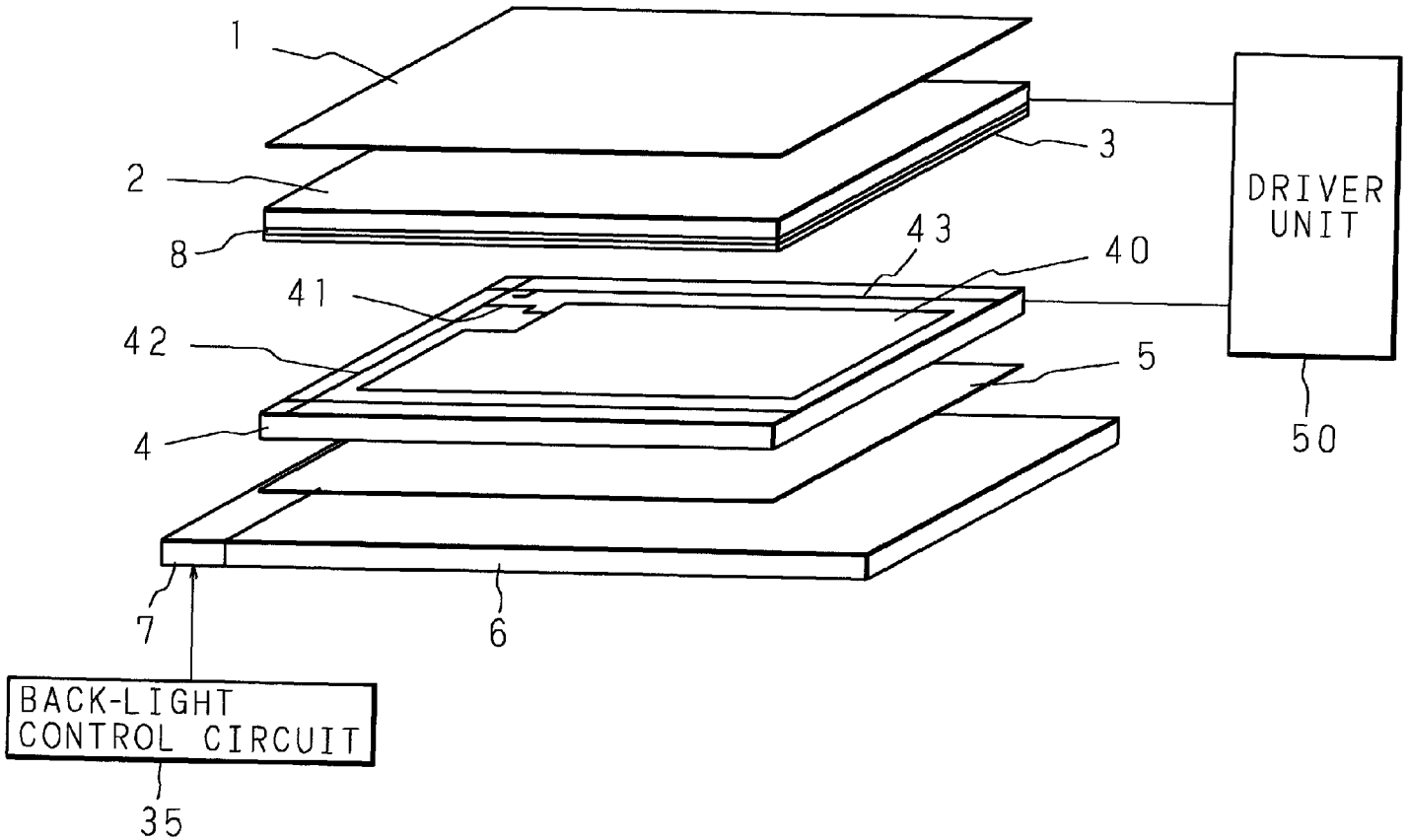
FIG. 6 is a schematic diagram showing an example of the entire structure of the liquid crystal display device of the present invention.

FIG. 4 is block diagram showing the structure of a liquid crystal display device of the present invention, FIG. 5 is a schematic cross sectional view showing a liquid crystal panel and back-light thereof, and FIG. 6 is a schematic diagram showing an example of the entire structure of the liquid crystal display device.

In FIG. 4, reference numerals 21 and 22 represent the liquid crystal panel and the back-light, respectively, whose cross sectional structure is shown in FIG. 5. As shown in FIG. 5, the back-light 22 is constituted by an LED array 7 emitting white light and a light guiding and diffusing plate 6.

As shown in FIGS. 5 and 6, the liquid crystal panel 21 is constituted by a polarizing film 1, a glass substrate 2 having a common electrode 3 and color filters 8 arranged in a matrix form, a glass substrate 4 having pixel electrodes 40 arranged in a matrix form, and a polarizing film 5, which are stacked in this order from the upper layer (surface) side to the lower layer (rear face) side.

A driver unit 50, which is constituted by a later-described data driver 32 and scan driver 33, is connected between the common electrode 3 and the pixel electrodes 40. The data driver 32 is connected to a TFT 41 through a signal line 42, and the scan driver 33 is connected to the TFT 41 through a scanning line 43. The TFT 41 is controlled to be on or off by the scan driver 33. Moreover, the individual pixel electrodes 40 are controlled to be on or off by the TFT 41. Consequently, the intensity of the transmitting light of each pixel is controlled by a signal from the data driver 32 supplied through the signal line 42 and TFT 41.

An alignment film 12 is placed on the upper face of the pixel electrodes 40 on the glass substrate 4, and an alignment film 11 is provided on the lower face of the common electrode 3. A liquid crystal material that is a ferroelectric liquid crystal or antiferroelectric liquid crystal is filled between the alignment films 11 and 12 to form a liquid crystal layer 13. Here, reference numeral 14 indicates spacers for maintaining the layer thickness of the liquid crystal layer 13.

The back-light 22 is disposed on the lower layer (rear face) side of the liquid crystal panel 21, and provided with the LED array 7 facing one end face of the light guiding and diffusing plate 6 that constitutes a light-emitting area. The light-guiding and diffusing plate 6 guides white light emitted from the respective LEDs of the LED array 7 through its entire surface and diffuses it toward the upper face, thereby functioning as the light-emitting area.

Here, an explanation will be given of a specific example of the liquid crystal display device of the present invention. First, the liquid crystal panel 21 shown in FIGS. 5 and 6 was formed as follows. A TFT substrate was fabricated by arranging individual pixel electrodes 40 with pitches of 0.24 mm×0.24 mm to form a matrix consisting of 1024×768 pixels with a diagonal length of 12.1 inches. After washing this TFT substrate and the glass substrate having the common electrode 3 and color filters 8, they were coated with polyamide by using a spin coater and then baked for one hour at 200° C. to form the alignment films 11 and 12 made of about 200 Å thick polyimide films.

Further, these alignment films 11 and 12 were rubbed with a cloth made of rayon, and stacked with a gap maintained therebetween by the spacers 14 made of silica having an average particle size of 1.6 μm so as to fabricate an empty panel. A ferroelectric liquid crystal composed mainly of a naphthalene-series liquid crystal was sealed between the alignment films 11 and 12 of this empty panel so as to form the liquid crystal layer 13. The panel thus fabricated was sandwiched by two polarizing films 1 and 5 maintained in a crossed-Nicol state so that a dark state could be produced when the ferroelectric liquid crystal molecules are titled to one direction, thereby forming the liquid crystal panel 21. This liquid crystal panel 21 and the back-light 22 for emitting white light were stacked. The light-emitting timing of the back-light 22 was controlled by a back-light control circuit 35.

Next, referring to FIG. 4, the following description will explain the circuit structure of the liquid crystal display device of the present invention. In FIG. 4, the reference numeral 30 represents an image memory to which display data DD from an external personal computer, for example, is inputted and in which the inputted display data DD is stored. The reference numeral 31 is a control signal generation circuit to which a synchronous signal SYN is inputted from the same personal computer and in which a control signal CS and a data conversion control signal DCS are generated. Pixel data PD is outputted from the image memory 30 to a data conversion circuit 36, and the data conversion control signal DCS is also outputted thereto from the control signal generation circuit 31. The data conversion circuit 36 generates inverted pixel data #PD by inverting the inputted pixel data PD in accordance with the data conversion control signal DCS.

Moreover, the control signal CS is outputted from the control signal generation circuit 31 to each of a reference voltage generation circuit 34, the data driver 32, scan driver 33, image memory 30 and back-light control circuit 35. The reference voltage generation circuit 34 generates reference voltages VR1 and VR2, and outputs the reference voltages VR1 and VR2 to the data driver 32 and the scan driver 33, respectively. The data driver 32 outputs a signal to the signal lines 42 of the pixel electrodes 40 based on the pixel data PD or inverted pixel data #PD received from the image memory 30 through the data conversion circuit 36. In synchronism with the output of this signal, the scan driver 33 scans sequentially the scanning lines 43 of the pixel electrodes 40 on a line by line basis. Furthermore, the back-light control circuit 35 applies a dive voltage to the back-light 22 so that the LED array 7 of the back-light 22 emits light.

Next, an explanation will be given of the operations of the liquid crystal display device according to the present invention. To the image memory 30, display data DD of the respective colors of red, green and blue to be displayed on the liquid crystal panel 21 are supplied from the personal computer. After storing temporarily the display data DD, the image memory 30 outputs pixel data PD that is the data corresponding to each pixel unit upon receipt of the control signal CS outputted from the control signal generation circuit 31. When the display data DD is supplied to the image memory 30, the synchronous signal SYN is fed to the control signal generation circuit 31. When the synchronous signal SYN is inputted, the control signal generation circuit 31 generates and outputs the control signal CS and the data conversion control signal DCS. The pixel data PD outputted from the image memory 30 is supplied to the data conversion circuit 36.

When the data conversion control signal DCS outputted from the control signal generation circuit 31 has the L level, the data conversion circuit 36 passes the pixel data PD as it is. On the other hand, when the data conversion control signal DCS has the H level, the data conversion circuit 36 generates and outputs the inverted pixel data #PD. Thus, in the control signal generation circuit 31, the data conversion control signal DCS is set to be the L level in data-write scanning, while it is set to be the H level in data-erase scanning. The control signal CS generated in the control signal generation circuit 31 is supplied to the data driver 32, scan driver 33, reference voltage generation circuit 34 and back-light control circuit 35.

The reference voltage generation circuit 34 generates the reference voltages VR1 and VR2 upon receipt of the control signal CS, and outputs the generated reference voltages VR1 and VR2 to the data driver 32 and the scan driver 33, respectively. Upon receipt of the control signal CS, the data driver 32 outputs a signal to the signal lines 42 of the pixel electrodes 40 based upon the pixel data PD or the inverted pixel data #PD outputted from the image memory 30 through the data conversion circuit 36. Upon receipt of the control signal CS, the scan driver 33 sequentially scans the scanning lines 43 of the pixel electrodes 40 on a line by line basis. In accordance with the output of the signal from the data driver 32 and the scanning by the scan driver 33, the TFT 41 is driven, a voltage is applied to the pixel electrodes 40 and the intensity of the transmitting light of the pixels is controlled.

The following description will specifically explain some embodiments of drive control in displaying a moving image on the liquid crystal display device of the present invention.

(First Embodiment)

Figure 7:
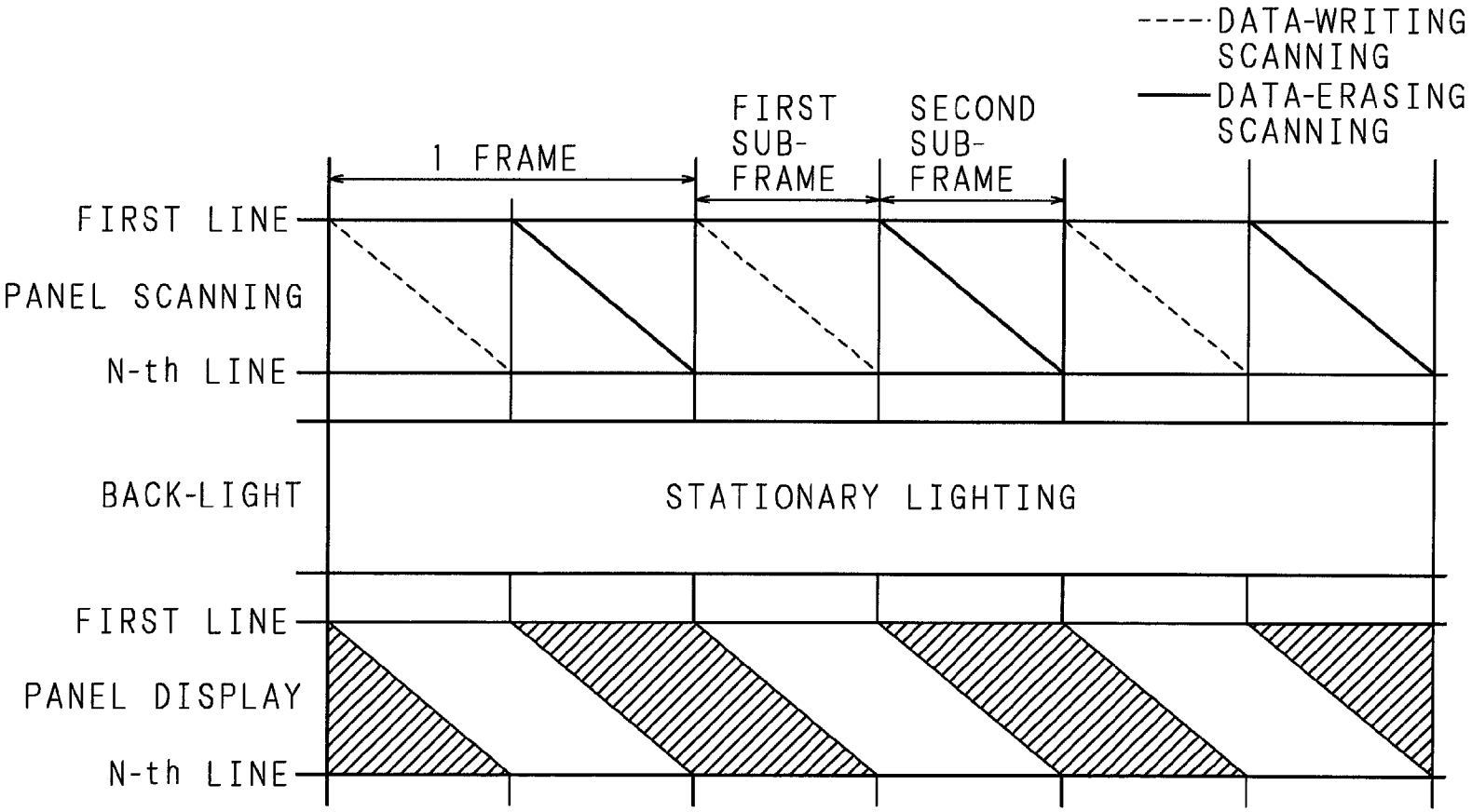
FIG. 7 is an illustration showing a drive sequence according to the first embodiment.
Figure 8:
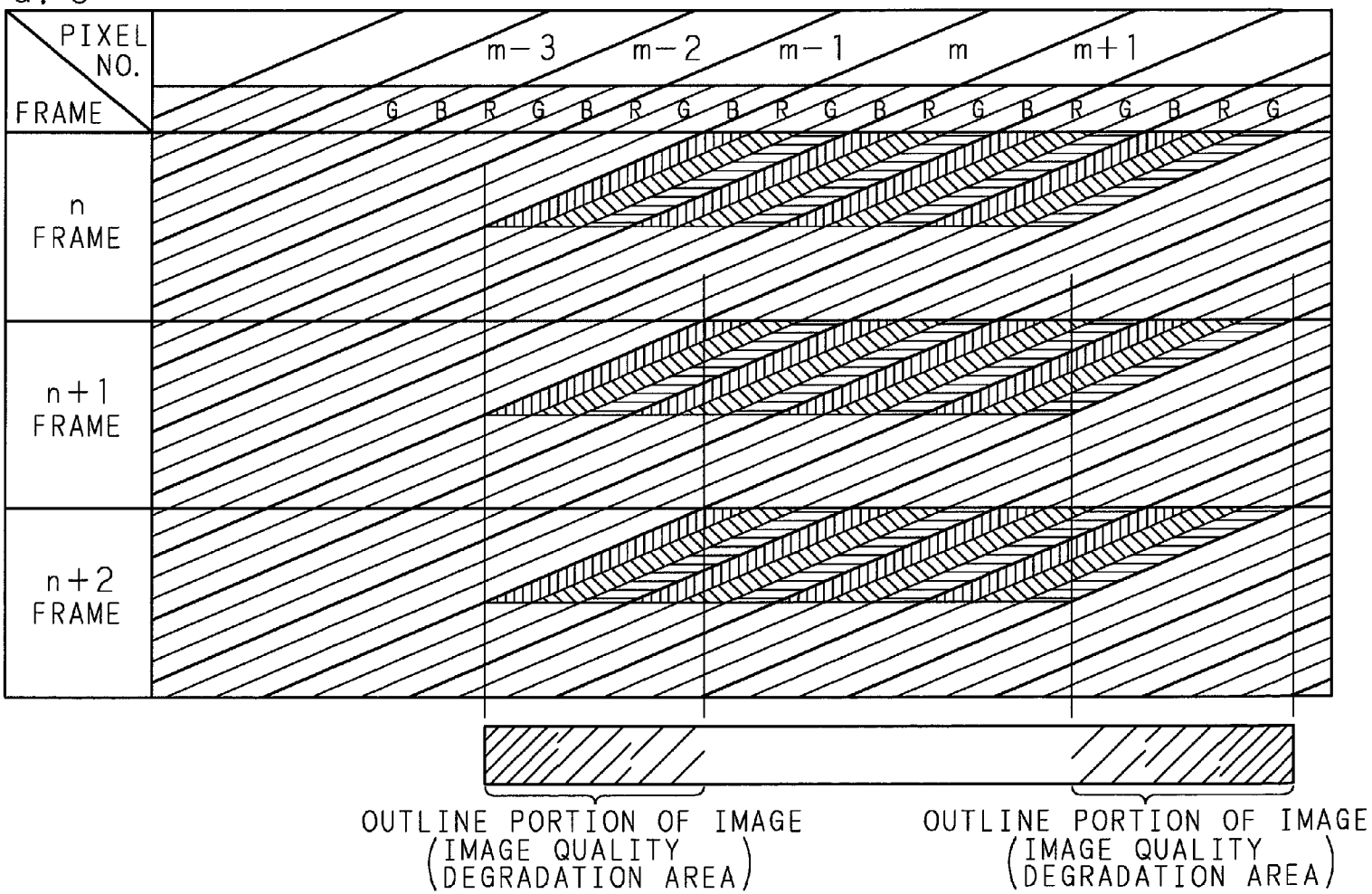
FIG. 8 is an illustration showing a visualized state of a moving image displayed by drive according to the first embodiment.

FIG. 7 is an illustration showing a drive sequence according to the first embodiment, and FIG. 8 is an illustration showing a visualized state of a moving image displayed by drive according to the first embodiment.

In the first embodiment, one frame is divided into two sub-frames, namely the first sub-frame and the second sub-frame, and data writing is performed in the leading first sub-frame and data erasure (i.e., black display) is implemented in the succeeding second sub-frame. During the data writing and the data erasure, the back-light 22 is kept in the "ON" state (stationary lighting).

Figure 1:
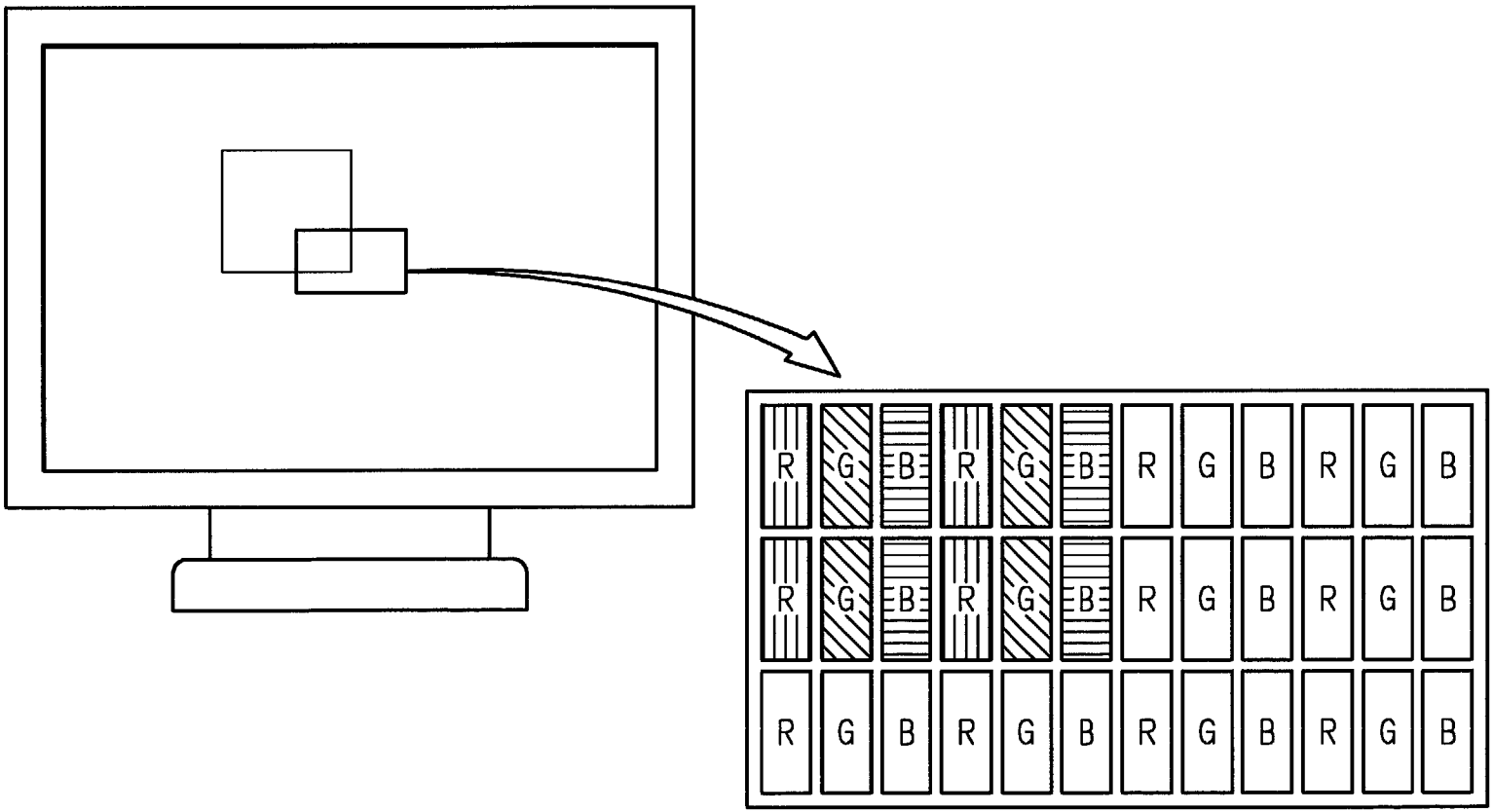
FIG. 1 PRIOR ART
FIG. 1 is a schematic view showing a basic image.
Figure 2:
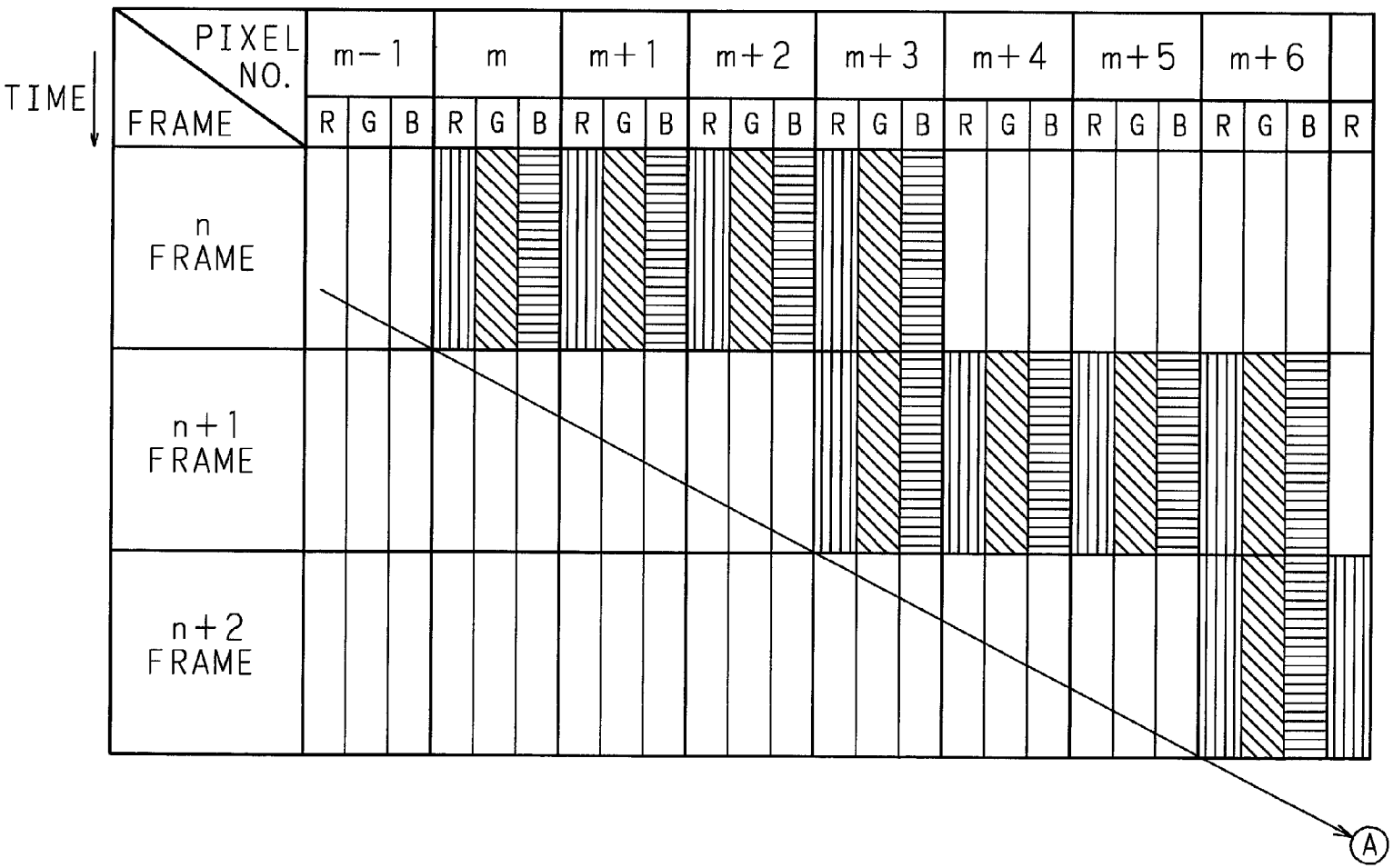
FIG. 2 PRIOR ART
FIG. 2 is an illustration of the pixel position in each frame in displaying a moving image.
Figure 3:
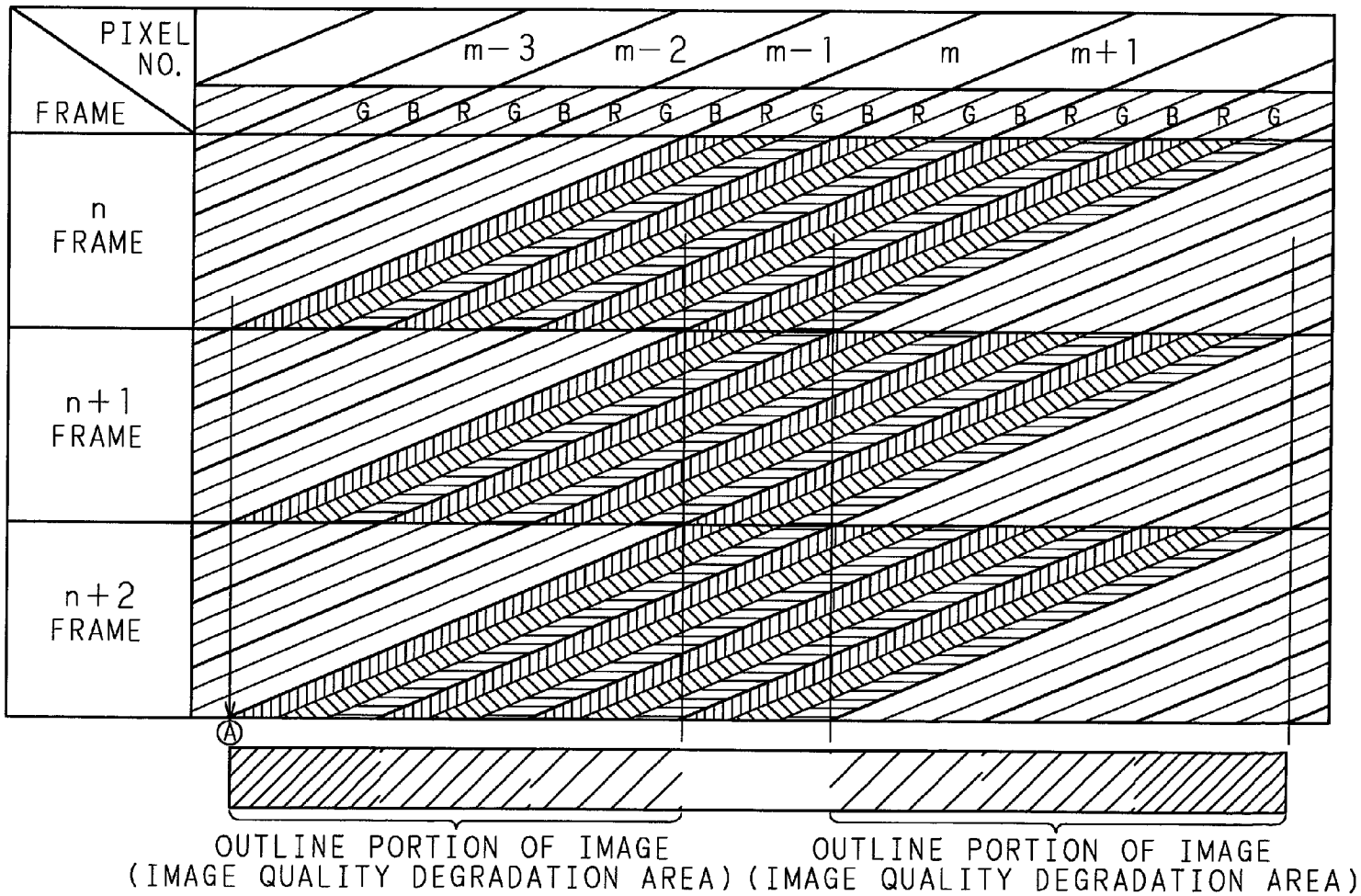
FIG. 3 PRIOR ART
FIG. 3 is an illustration showing a visualized state of a moving image displayed according to a conventional example.

Consequently, as shown in FIG. 8, in comparison with FIG. 3 illustrating a conventional example, the range in which the outline portion is displayed as a blur becomes narrower and the area where degradation of the image quality occurs is reduced, thereby improving the image quality.

(Second Embodiment)

Figure 9:
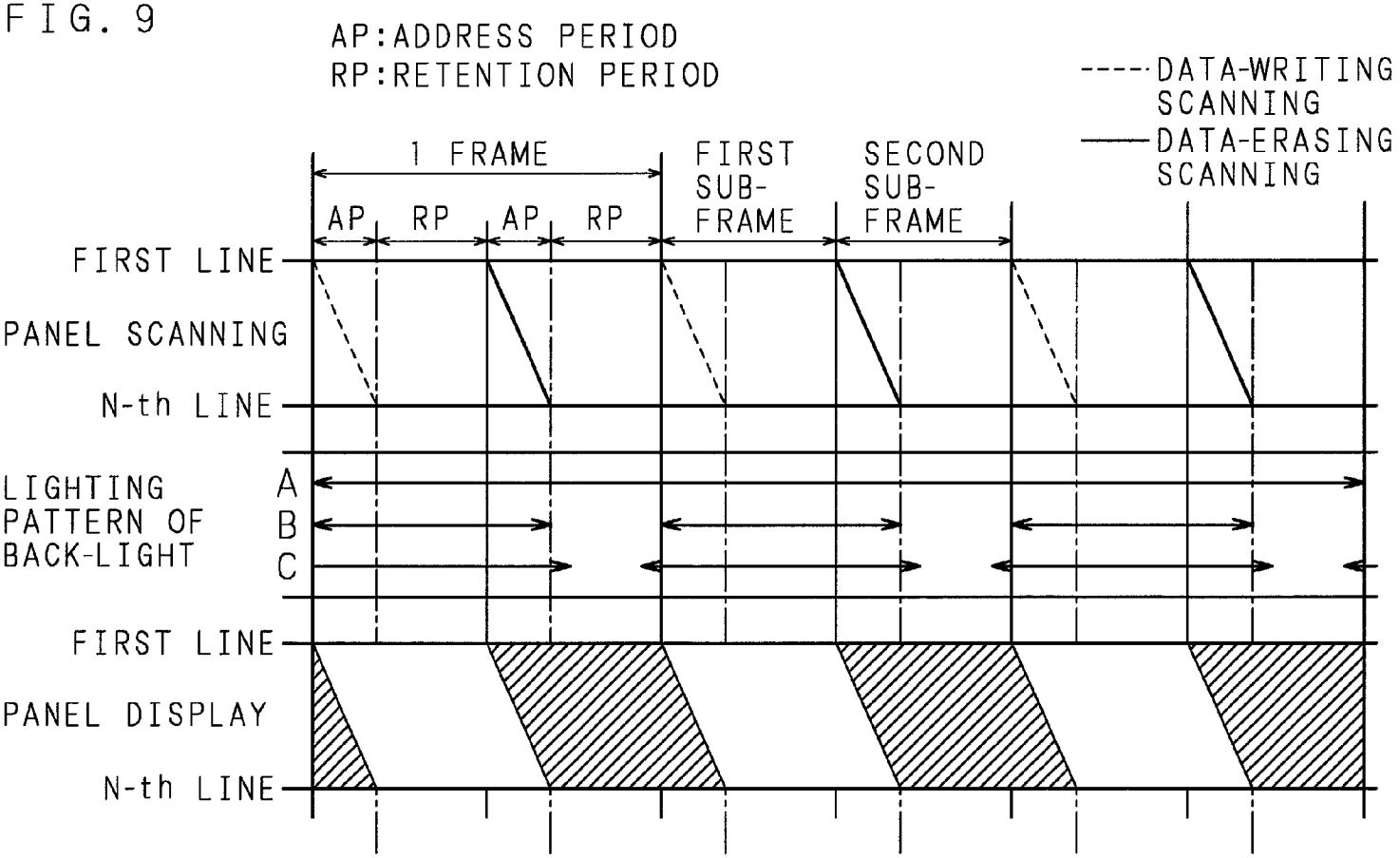
FIG. 9 is an illustration showing a drive sequence according to one example of the second embodiment.

FIG. 9 is an illustration showing a drive sequence according to one example of the second embodiment. In the second embodiment, one frame is divided into two sub-frames, namely the first sub-frame and the second sub-frame, and data writing is performed in the leading first sub-frame and data erasure (i.e., black display) is implemented in the succeeding second sub-frame. In this case, each of the first and second sub-frames is divided into a leading address period and a succeeding retention period, and the data to be displayed on the liquid crystal panel 21 is written in the leading address period of the first sub-frame. After the writing is complete, the data is held during the succeeding retention period, and then the written data is erased in the leading address period of the second sub-frame. After the erasure is complete, the erased state is kept during the succeeding retention period of the second sub-frame.

Lighting patterns of the back-light 22 may include: a mode (mode A) in which the back-light 22 is in the "ON" state during the entire period; a mode (mode B) in which the back-light 22 is in the "ON" state during the entire period of the first sub-frame and the address period of the second sub-frame; and a mode (mode C) in which the back-light 22 is turned on at a given first timing within the retention period of the second sub-frame, kept in the "ON" state during the entire period of the first sub-frame, and continues to be in the "ON" state until a given second timing within the retention period of the next second sub-frame. If the back-light 22 is turned on only in a necessary period, it is possible to reduce the power consumption. According to such a drive sequence, an advantageous effect equivalent to that of the first embodiment is produced.

Figure 10:
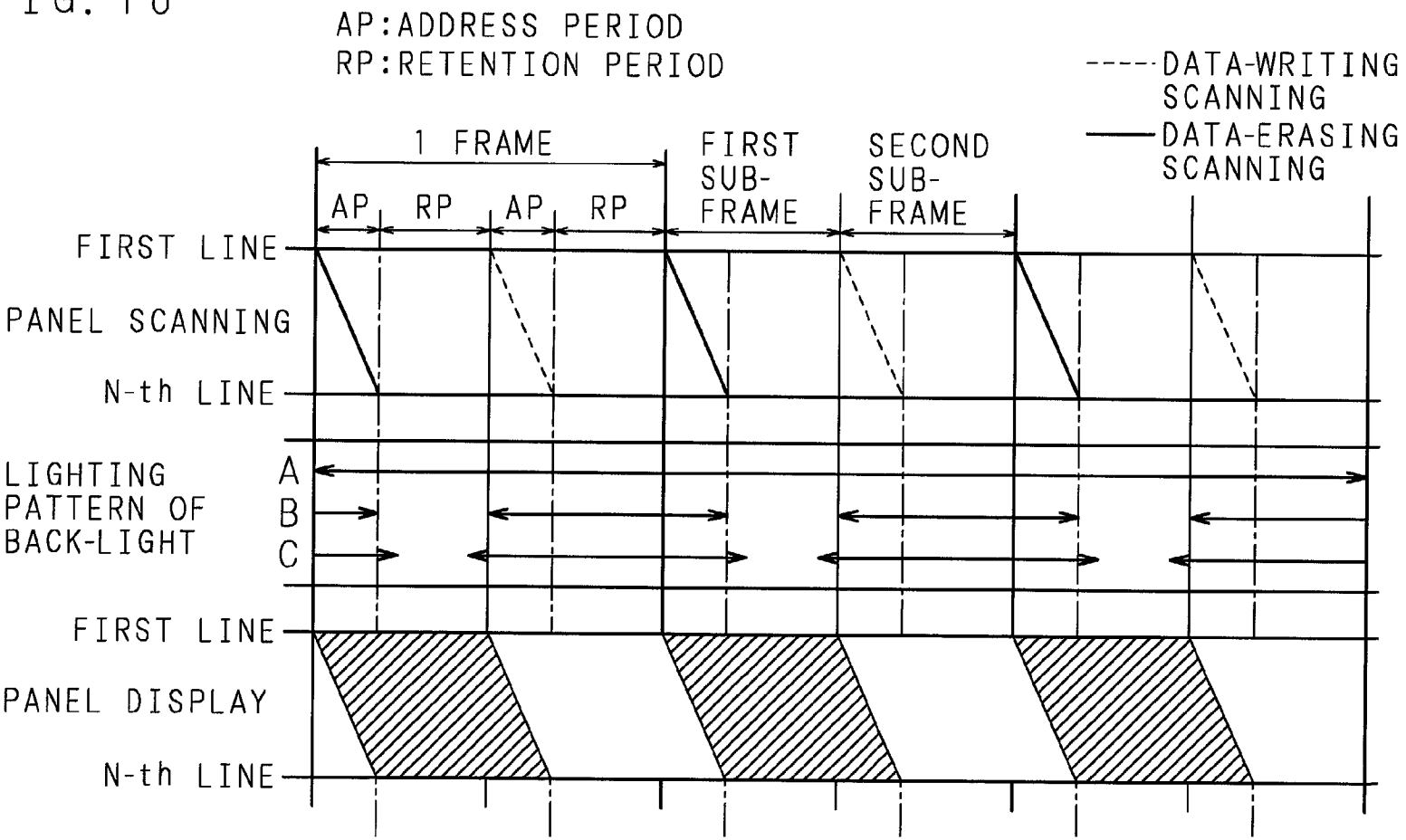
FIG. 10 is an illustration showing a drive sequence according to another example of the second embodiment.

FIG. 10 is an illustration showing a drive sequence according to another example of the second embodiment. In this example, data erasure is executed in the address period of the first sub-frame, and data writing is carried out in the address period of the second sub-frame. In this case, lighting patterns of the back-light 22 may include three types of modes (modes A, B and C) similar to those of the above example in which the back-light 22 is turned on mainly in the retention period of the second sub-frame.

(Third Embodiment)

Figure 11:
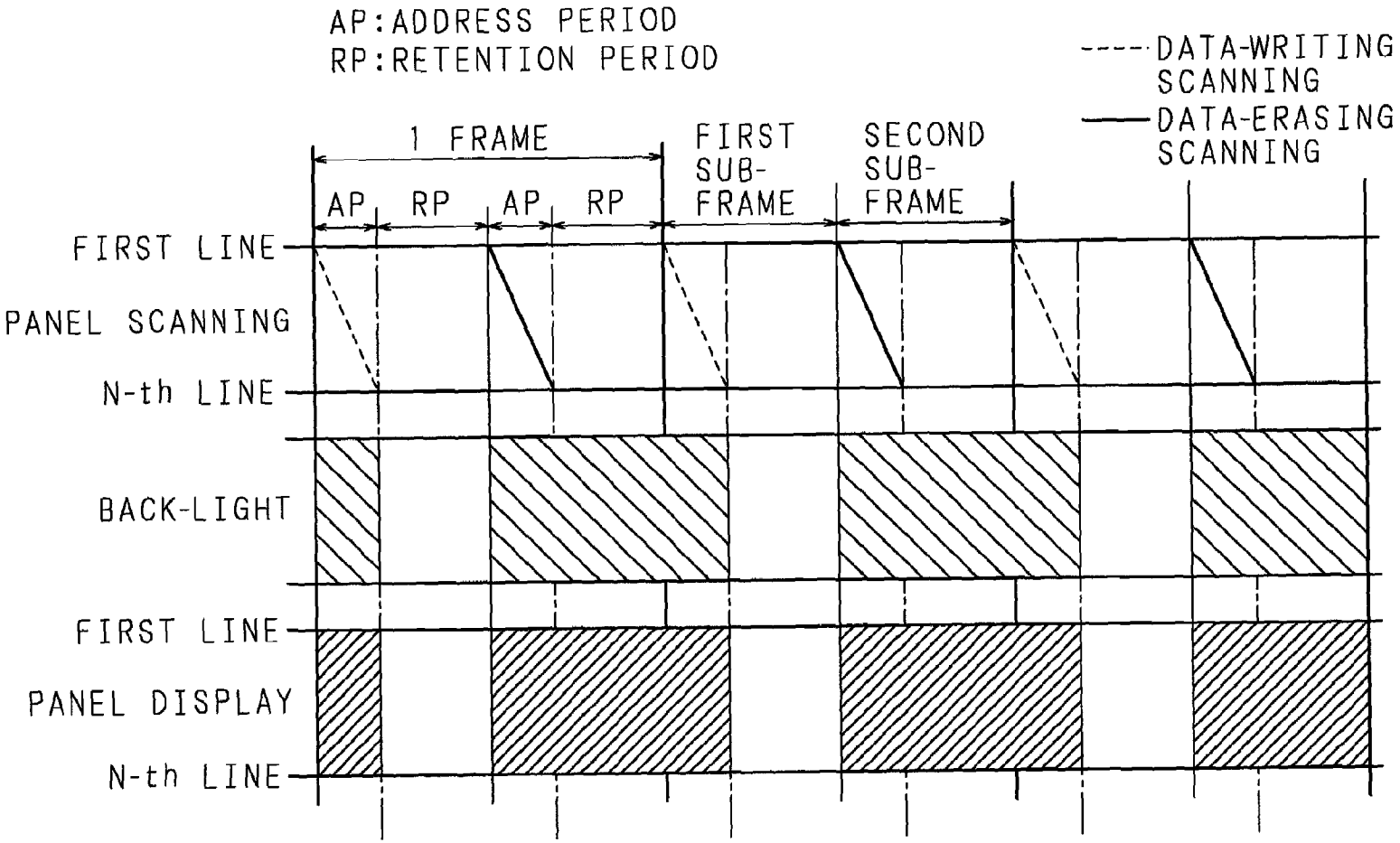
FIG. 11 is an illustration showing a drive sequence according to the third embodiment.

FIG. 11 is an illustration showing a drive sequence according to the third embodiment. The data writing process and data erasing process in the third embodiment are the same as those in the above-described second embodiment. Accordingly, data writing is performed in the address period of the first sub-frame and data erasure is executed in the address period of the second sub-frame. The back-light 22 is turned on only in the retention period of the first sub-frame to display the written data.

Figure 12:
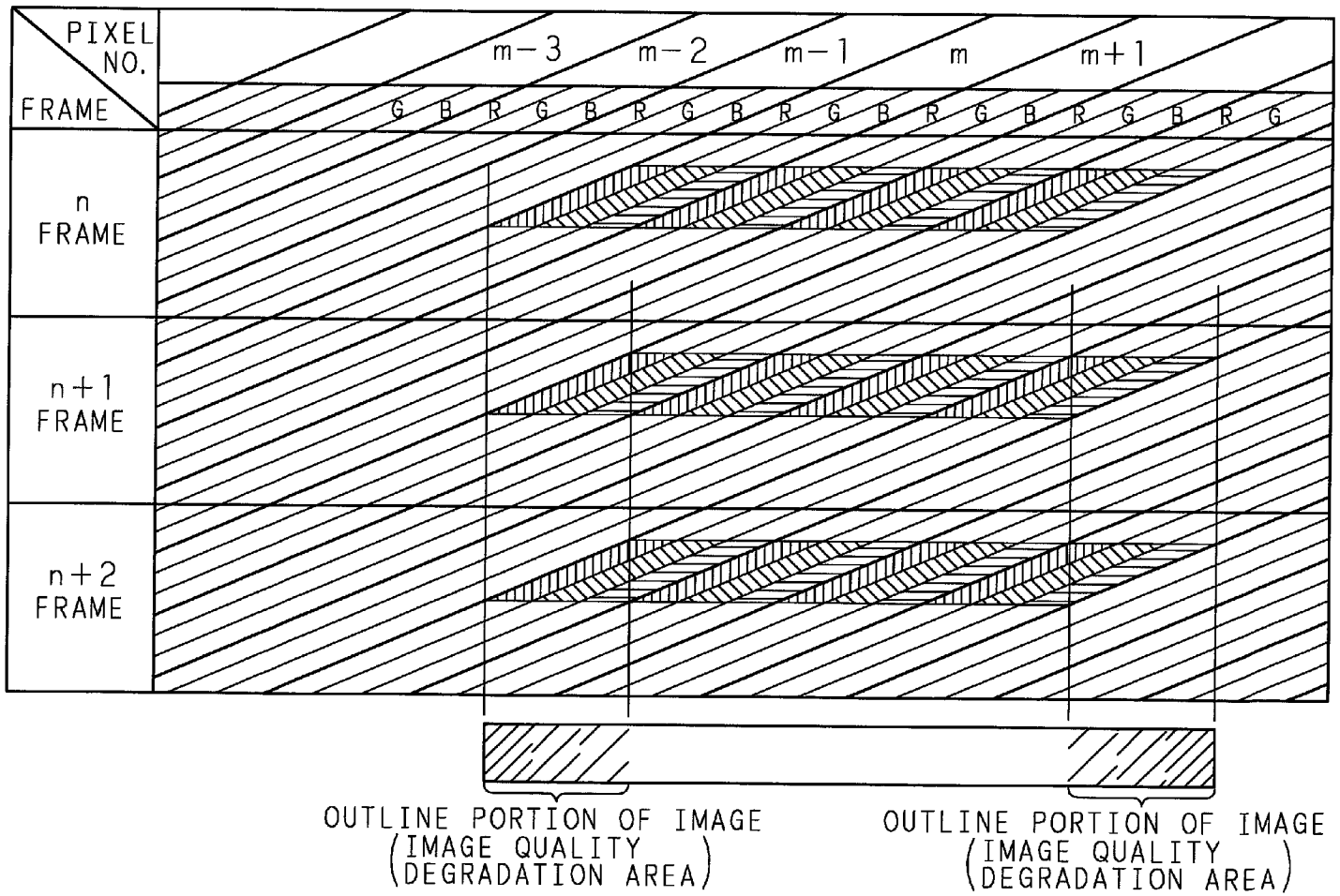
FIG. 12 is an illustration showing a visualized state of a moving image displayed by drive according to the third embodiment.

FIG. 12 is an illustration showing a visualized state of a moving image displayed by drive according to the third embodiment. In comparison with the conventional example, the range in which the outline portion is seen as a blur becomes narrower and the area where degradation of the image quality occurs is reduced, thereby improving the image quality. Moreover, in comparison with the first embodiment, since the time during which the back-light 22 is in the "ON" state is shorter, it is possible to further reduce the degradation of the image quality resulting from the display of moving image, thereby achieving a further improvement in the image quality.

Besides, in this third embodiment, like the above-described another example of the second embodiment, it is possible to perform a drive sequence in which data erasure is executed in the address period of the first sub-frame and data writing is carried out in the address period of the second sub-frame. In this case, the back-light 22 is turned on only in the retention period of the second sub-frame.

(Fourth Embodiment)

Figure 13:
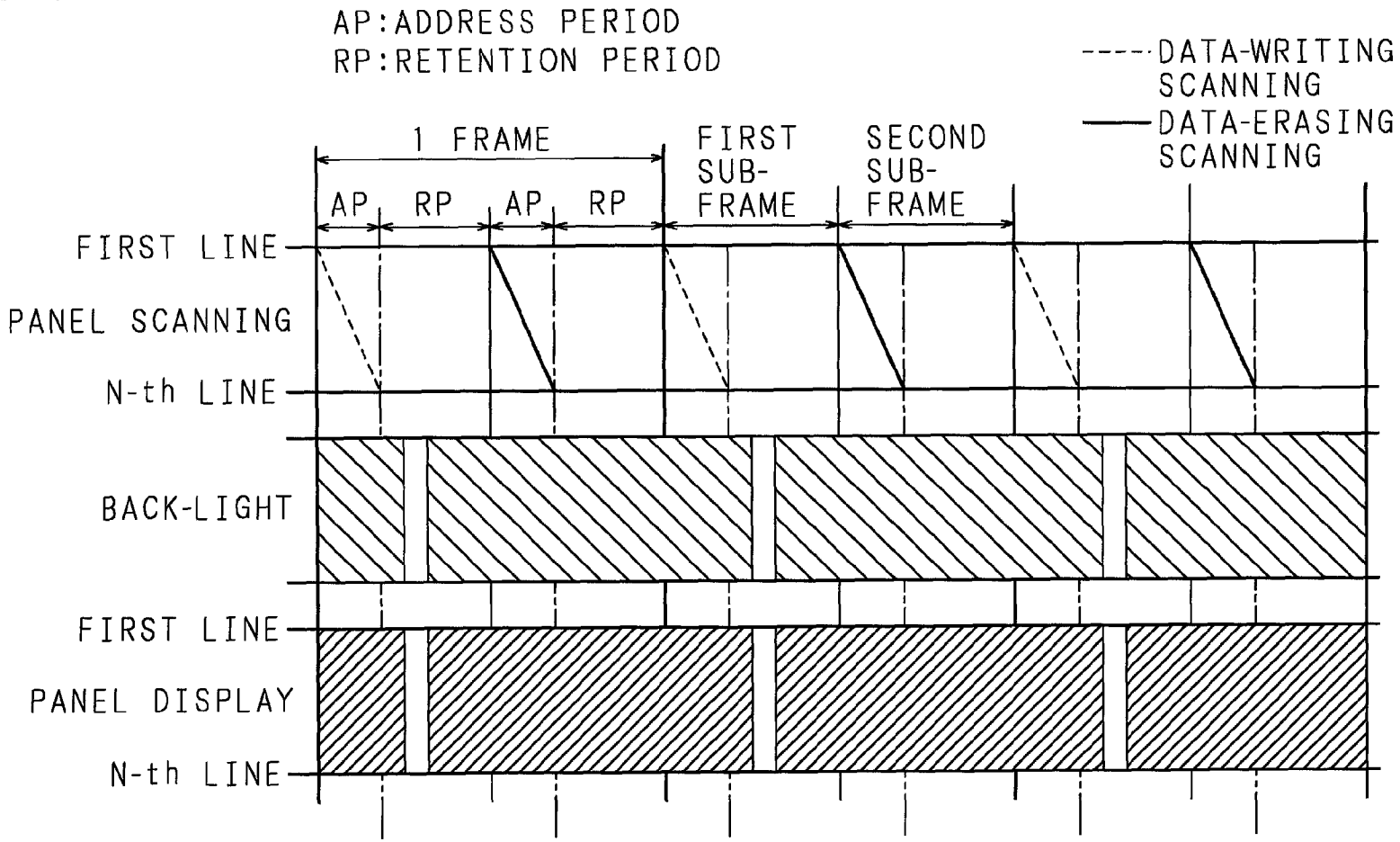
FIG. 13 is an illustration showing a drive sequence according to the fourth embodiment.

FIG. 13 is an illustration showing a drive sequence according to the fourth embodiment. The data writing process and data erasing process in the fourth embodiment are the same as those in the above-described second and third embodiments. Accordingly, data writing is performed in the address period of the first sub-frame and data erasure is executed in the address period of the second sub-frame. In the third embodiment, the back-light 22 is in the "ON" state during the entire period of the retention period. In contrast, in this fourth embodiment, the back-light 22 is turned on only in a certain period within the retention period to display the written data.

Figure 14:
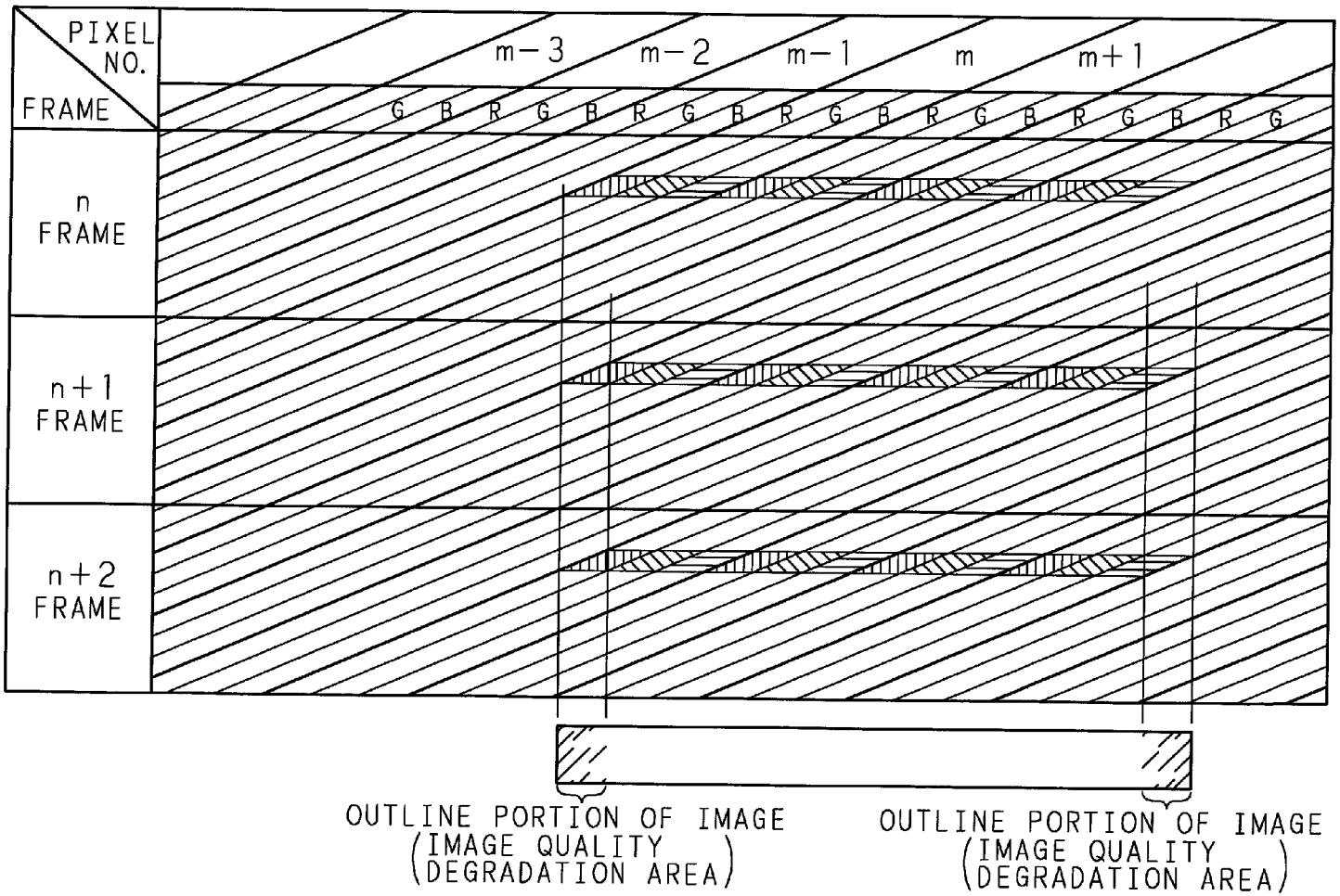
FIG. 14 is an illustration showing a visualized state of a moving image displayed by drive according to the fourth embodiment.

FIG. 14 is an illustration showing a visualized state of a moving image displayed by drive according to the fourth embodiment. In comparison with the third embodiment, since the time during which the back-light 22 is in the "ON" state is further reduced, it is possible to further reduce the degradation of the image quality resulting from the display of moving image, thereby achieving a further improvement in the image quality. This fourth embodiment is suitable for an occasion where an image is displayed in a dark environment.

Besides, in this fourth embodiment, like the above-described another example of the second embodiment, it is possible to perform a drive sequence in which data erasure is carried out in the address period of the first sub-frame and data writing is executed in the address period of the second sub-frame. In this case, the back-light 22 is turned on only in a certain period within the retention period of the second sub-frame.

(Fifth Embodiment)

Figure 15:
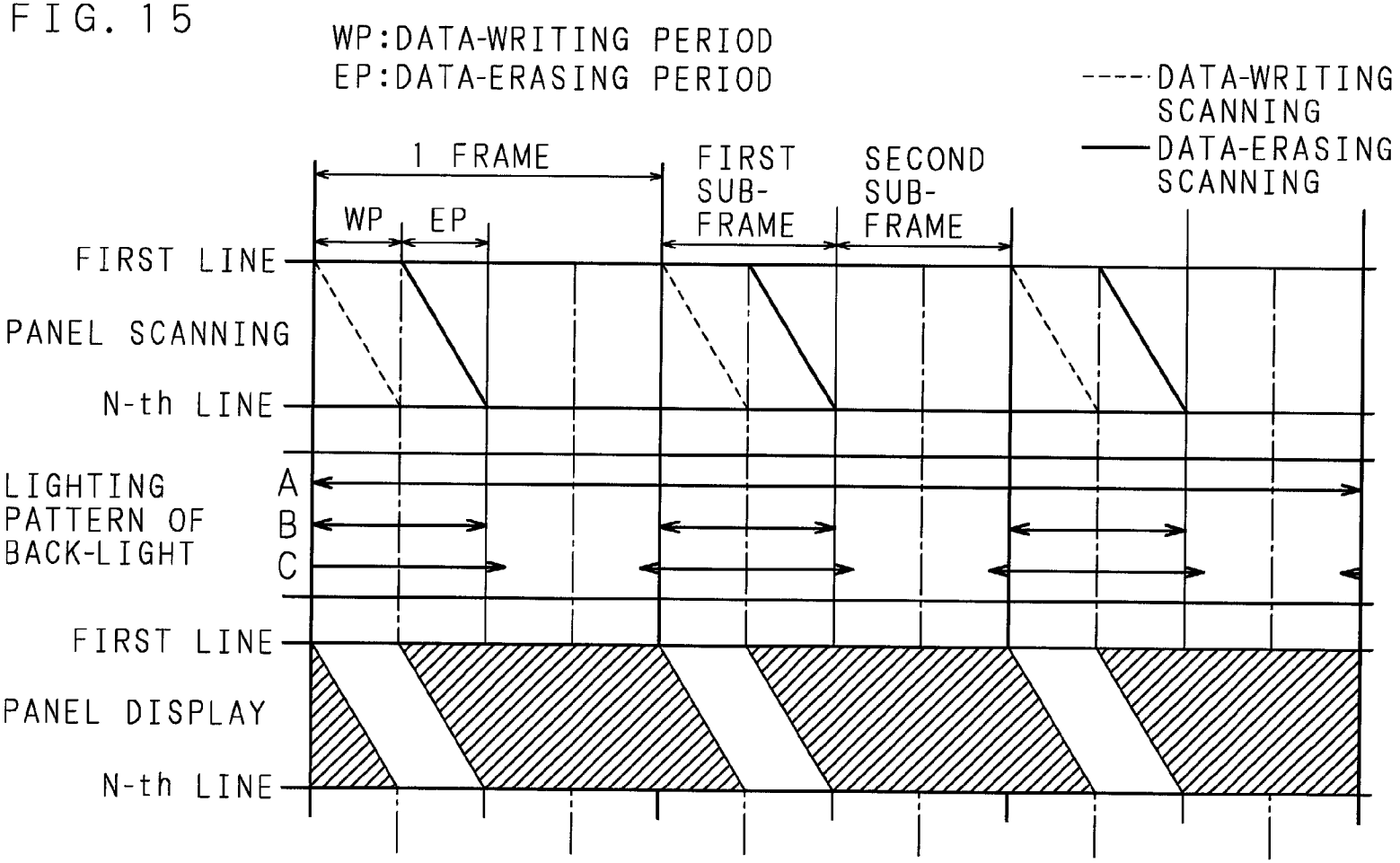
FIG. 15 is an illustration showing a drive sequence according to one example of the fifth embodiment.

FIG. 15 is an illustration showing a drive sequence according to one example of the fifth embodiment. In the fifth embodiment, one frame is divided into two sub-frames, namely the first sub-frame and the second sub-frame, and the first sub-frame is further divided into two halves: a leading data write period and a succeeding data erasure period. Data writing is performed in the data write period of the first sub-frame, and data erasure (i.e., black display) is executed in the succeeding data erasure period. Within the first sub-frame, data erasure is started immediately after the completion of data writing. In the second sub-frame, the liquid crystal panel 21 is not activated at all. According to such a drive sequence, an advantageous effect equivalent to that of the first embodiment is produced.

Lighting patterns of the back-light 22 may include: a mode (mode A) in which the back-light 22 is in the "ON" state during the entire period; a mode (mode B) in which the back-light 22 is in the "ON" state in the first sub-frame, while it is in the "OFF" state in the second sub-frame; and a mode (mode C) in which the back-light 22 is turned on at a given first timing within the second sub-frame immediately before the start of the first sub-frame, kept in the "ON" state during the entire period of the first sub-frame, and continues to be in the "ON" state until a given second timing within the second sub-frame immediately after the end of the first sub-frame. If the back-light 22 is turned on only in a necessary period, it is possible to reduce the power consumption.

Figure 16:
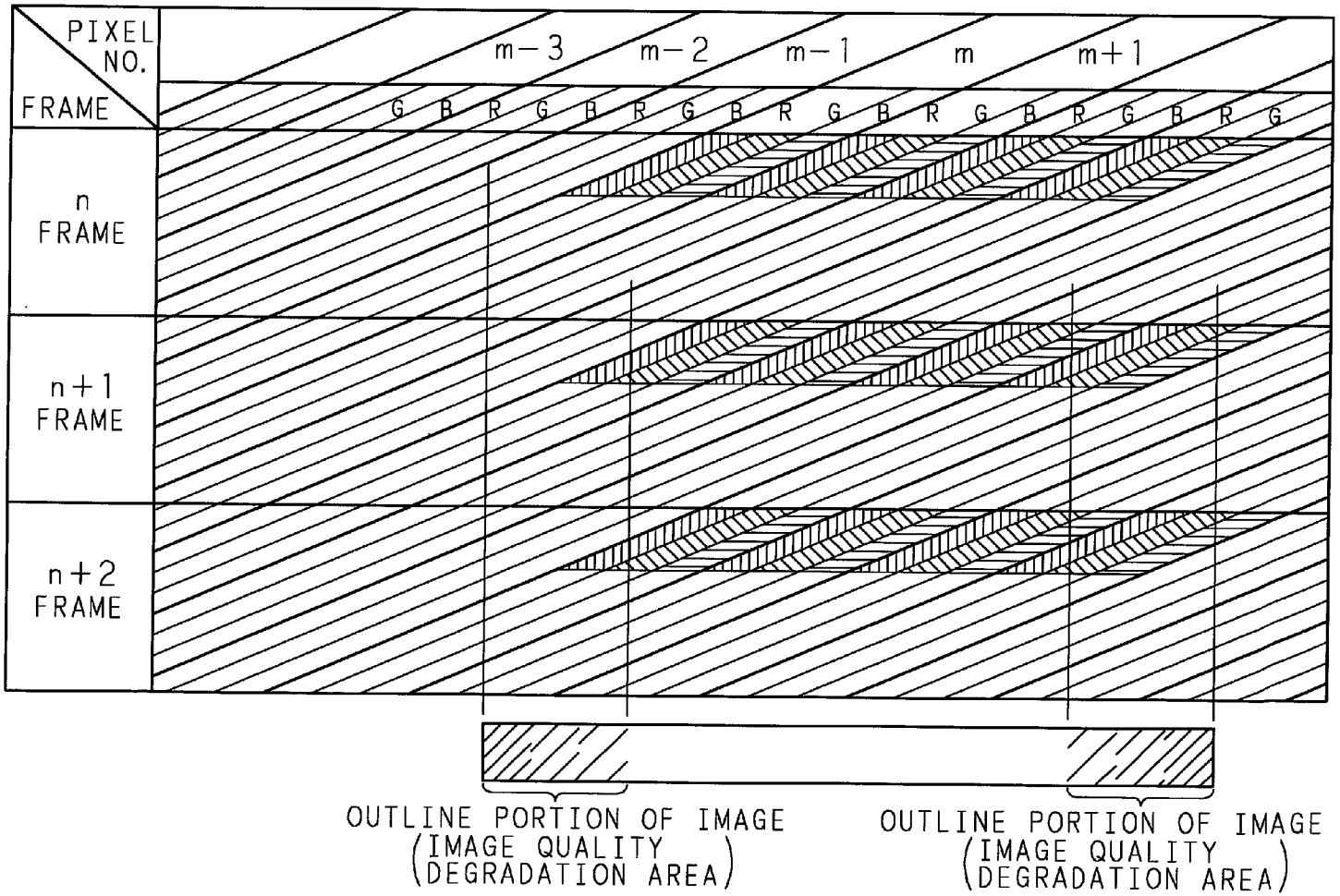
FIG. 16 is an illustration showing a visualized state of a moving image displayed by drive according to the fifth embodiment.

FIG. 16 is an illustration showing a visualized state of a moving image displayed by drive according to the fifth embodiment. In comparison with the conventional example, the range in which the outline portion is seen as a blur becomes narrower and the area where degradation of the image quality occurs is reduced, thereby improving the image quality.

Figure 17:
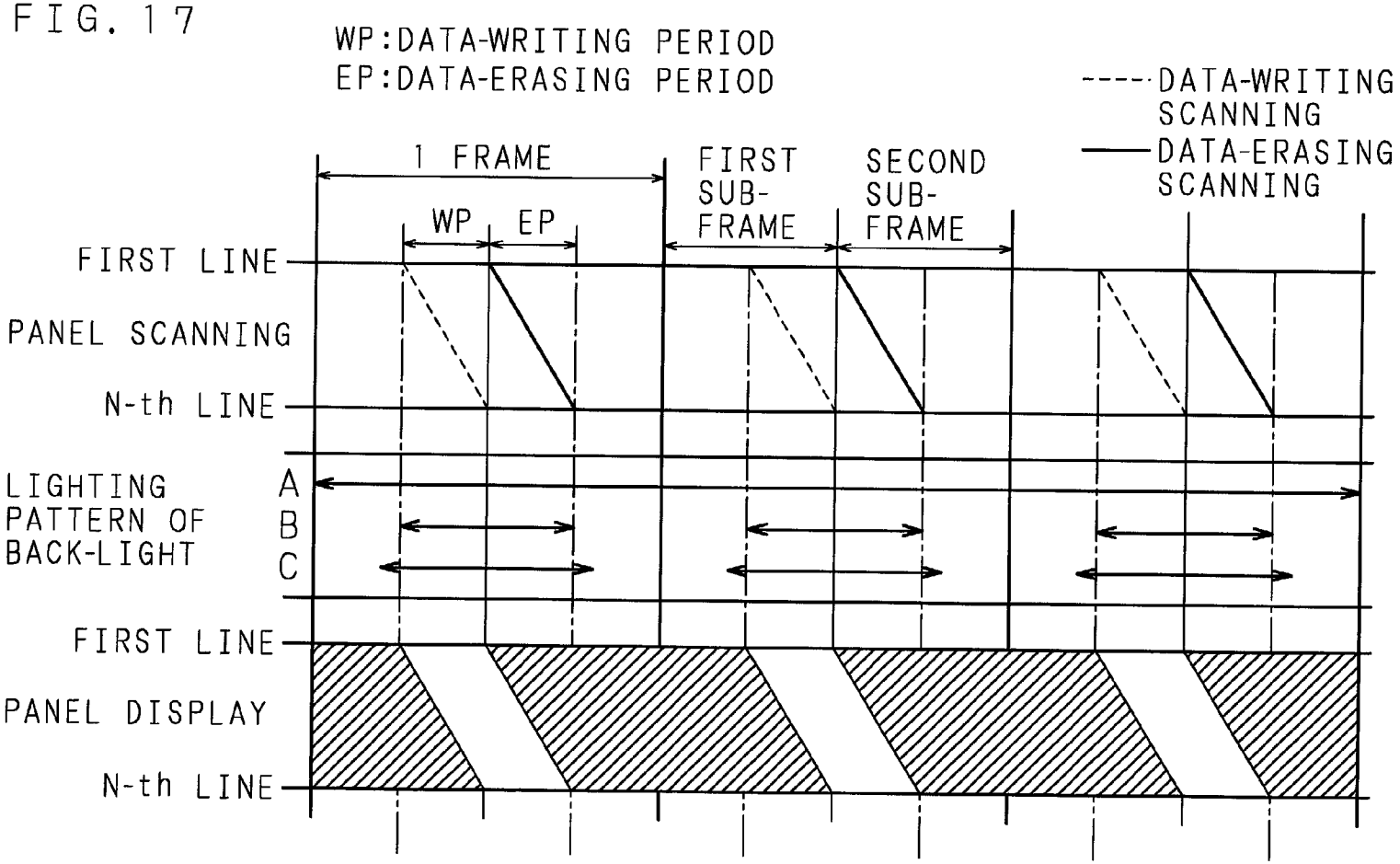
FIG. 17 is an illustration showing a drive sequence according to another example of the fifth embodiment.

FIG. 17 is an illustration showing a drive sequence according to another example of the fifth embodiment. In this example, data writing is performed in the succeeding data write period of the first sub-frame, data erasure is executed in the leading data erasure period of the next second sub-frame, and the liquid crystal panel 21 is suspended during other periods. In this case, lighting patterns of the back-light 22 may include: a mode (mode A) in which the back-light 22 is in the "ON" state during the entire period; and two types of modes (mode B and mode C) similar to the above example in which the back-light 22 is turned on mainly in the data write period and data erasure period.

Figure 18:
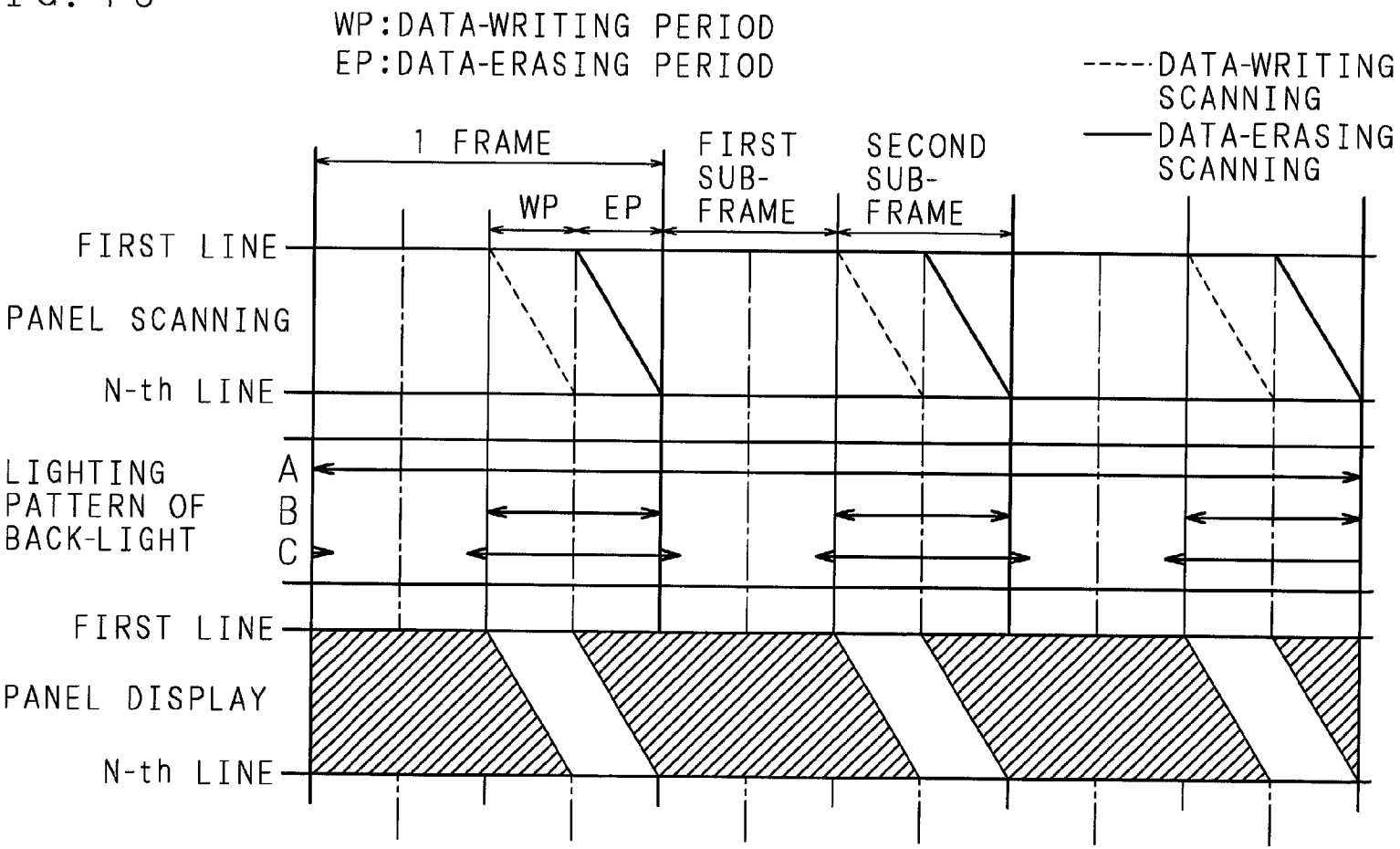
FIG. 18 is an illustration showing a drive sequence according to still another example of the fifth embodiment.

FIG. 18 is an illustration showing a drive sequence according to still another example of the fifth embodiment. In this example, data writing is performed in the leading data write period of the second sub-frame, data erasure is executed in the succeeding data erasure period of the second sub-frame, and the liquid crystal panel 21 is suspended during other periods. In this case, lighting patterns of the back-light 22 may include: a mode (mode A) in which the back-light 22 is in the "ON" state during the entire period; and two types of modes (modes B and C) similar to the above examples in which the back-light 22 is turned ON mainly in the data write period and data erasure period.

In the fifth embodiment as described above, since data erasure is started upon the completion of data writing, it is possible to readily control the write and erasure operations with respect to the liquid crystal panel 21.

(Sixth Embodiment)

Figure 19:
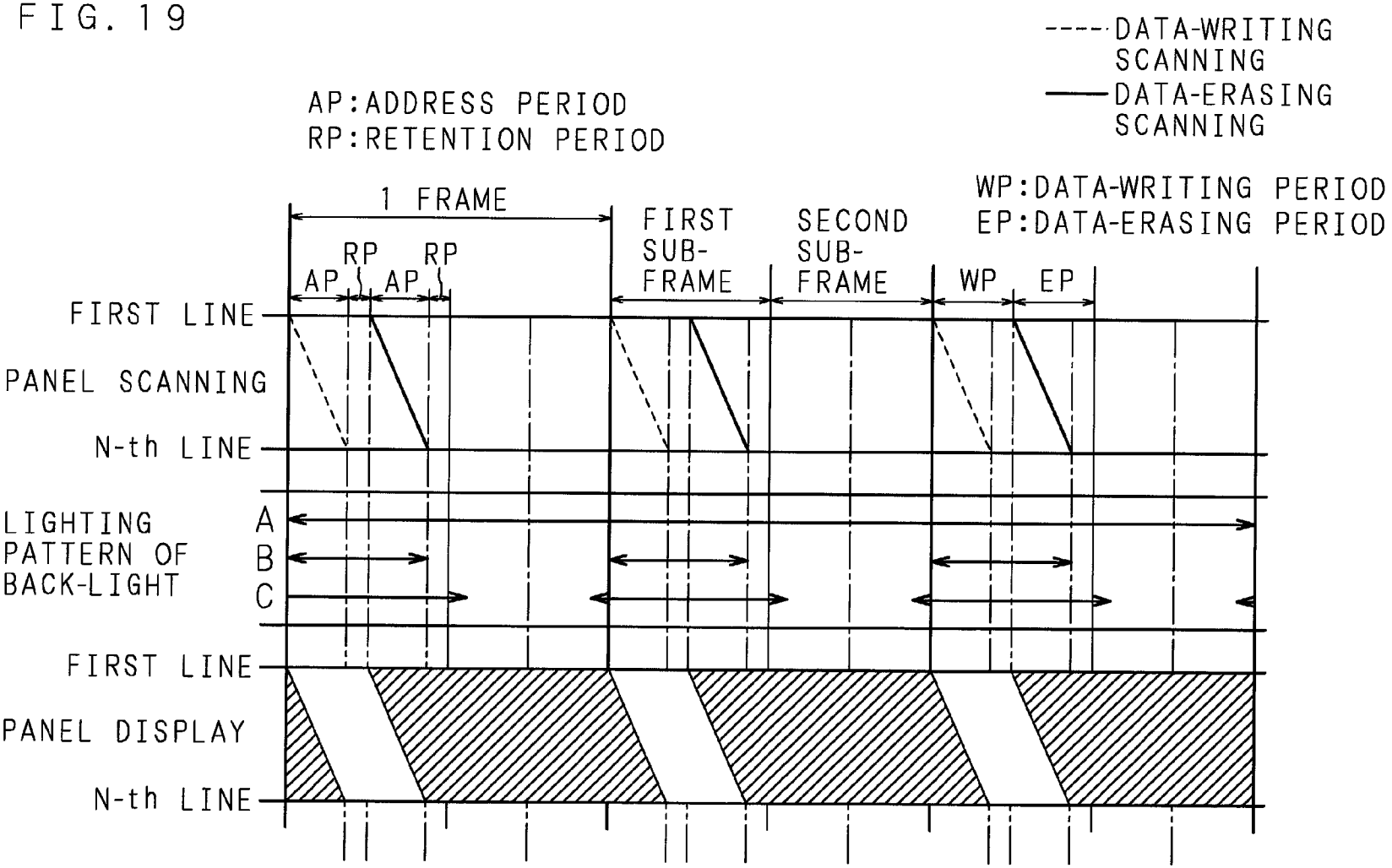
FIG. 19 is an illustration showing a drive sequence according to one example of the sixth embodiment.

FIG. 19 is an illustration showing a drive sequence according to one example of the sixth embodiment. In the sixth embodiment, like the fifth embodiment, one frame is divided into two sub-frames, namely the first sub-frame and the second sub-frame, and the first sub-frame is further divided into two halves: a leading data write period and a succeeding data erasure period. Furthermore, in the sixth embodiment, each of the data write period and data erasure period is divided into a leading address period and a succeeding retention period, and data writing is performed in the address period of the data write period of the first sub-frame and data erasure (i.e., black display) is executed in the address period of the data erasure period of the first sub-frame. Within the first sub-frame, data writing is executed in the address period of the data write period, the retention period starts after the completion of the data writing, and then data erasure is performed in the address period of the data erasure period. In the second sub-frame, the liquid crystal panel 21 is not activated at all.

Lighting patterns of the back-light 22 may include: a mode (mode A) in which the back-light 22 is in the "ON" state during the entire period; a mode (mode B) in which the back-light 22 is in the "ON" state during the entire period of the data write period and the address period of the data erasure period within the first sub-frame, and in the "OFF" state during other periods; and a mode (mode C) in which the back-light 22 is turned on at a given first timing within the second sub-frame immediately before the start of the first sub-frame, kept in the "ON" state during the entire period of the first sub-frame, and continues to be in the "ON" state until a given second timing within the next second sub-frame. If the back-light 22 is turned on only in a necessary period, it is possible to reduce the power consumption. According to such a drive sequence, an advantageous effect equivalent to that of the fifth embodiment is produced.

Figure 20:
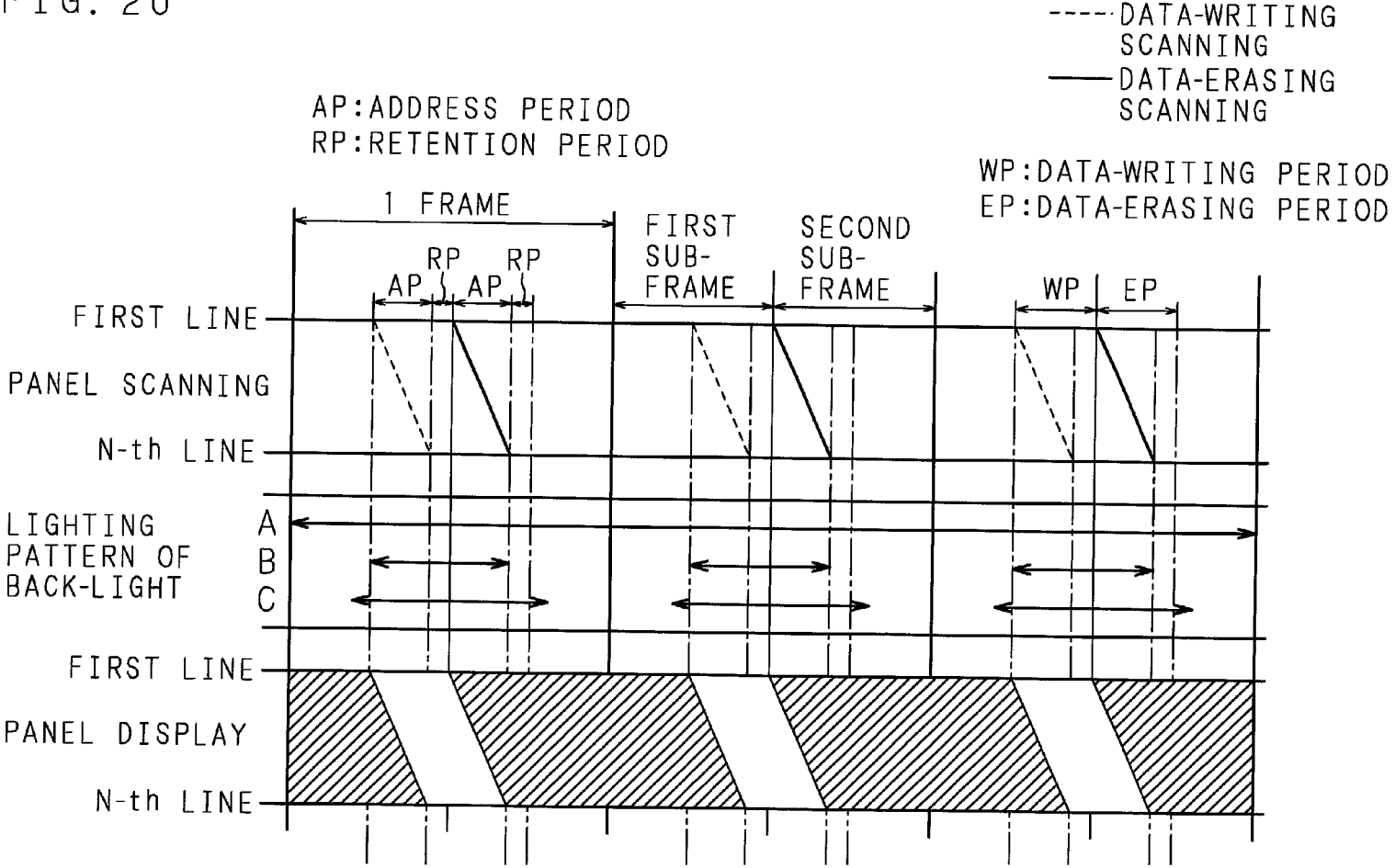
FIG. 20 is an illustration showing a drive sequence according to another example of the sixth embodiment.

FIG. 20 is an illustration showing a drive sequence according to another example of the sixth embodiment. In this example, data writing is performed in the address period of the succeeding data write period of the first sub-frame, data erasure is executed in the address period of the leading data erasure period of the second sub-frame, and the liquid crystal panel 21 is suspended during other periods. In this case, lighting patterns of the back-light 22 may include: a mode (mode A) in which the back-light 22 is in the "ON" state during the entire period; and two types of modes (modes B and C) similar to the above example in which the back-light 22 is turned on mainly in the respective address periods of the data write period and data erasure period.

Figure 21:
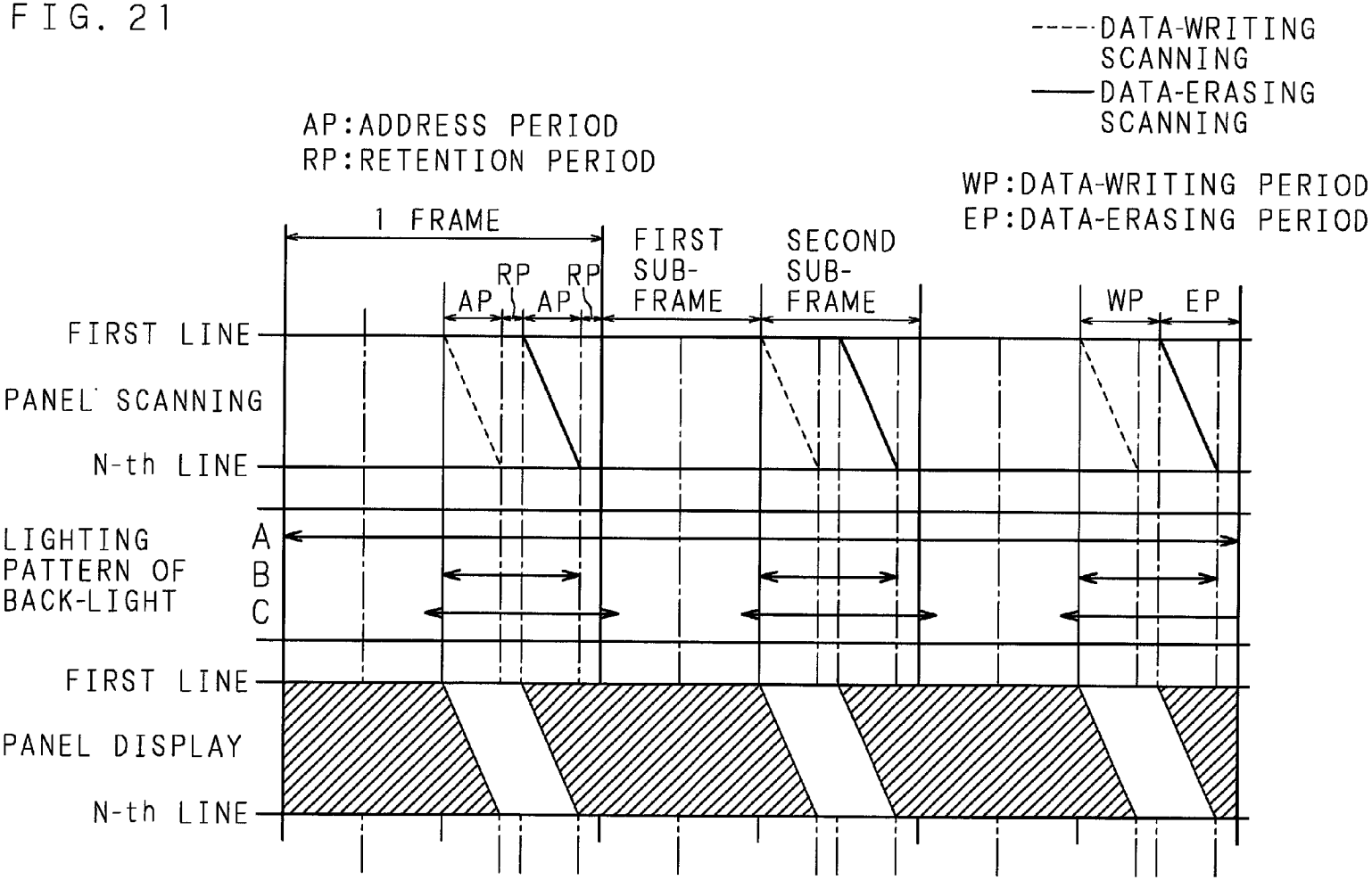
FIG. 21 is an illustration showing a drive sequence according to still another example of the sixth embodiment.

FIG. 21 is an illustration showing a drive sequence according to still another example of the sixth embodiment. In this example, data writing is performed in the address period of the leading data write period of the second sub-frame, data erasure is executed in the address period of the succeeding data erasure period of the second sub-frame, and the liquid crystal panel 21 is suspended during other periods. In this case, lighting patterns of the back-light 22 may include: a mode (mode A) in which the back-light 22 is in the "ON" state during the entire period; and two types of modes (modes B and C) similar to the above example in which the back-light 22 is turned on mainly in the respective address periods of the data write period and data erasure period.

(Seventh Embodiment)

Figure 22:
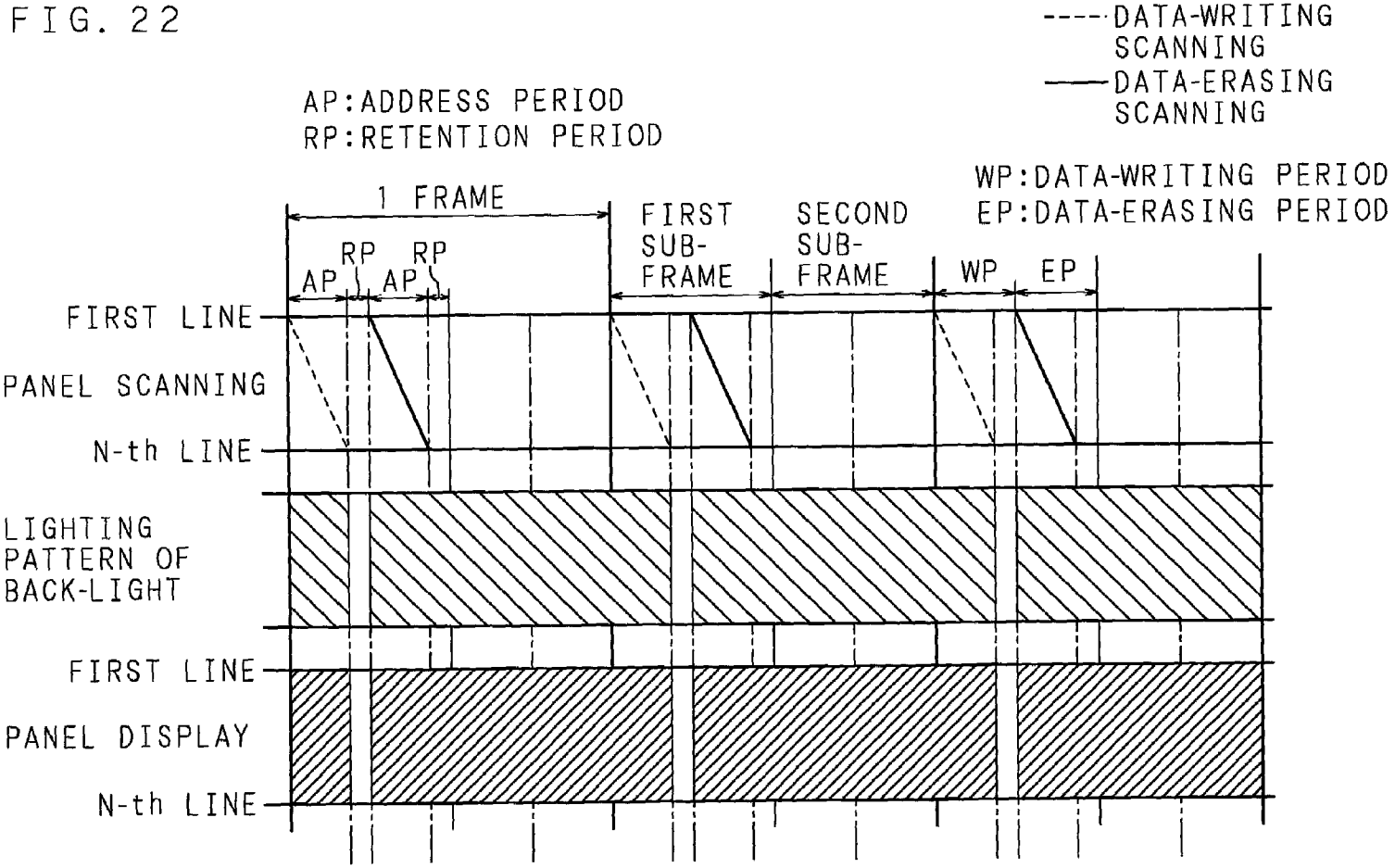
FIG. 22 is an illustration showing a drive sequence according to the seventh embodiment.

FIG. 22 is an illustration showing a drive sequence according to the seventh embodiment. The data writing process and data erasing process in the seventh embodiment are the same as those in the above-described sixth embodiment. Accordingly, data writing is executed in the address period of the data write period of the first sub-frame, and data erasure is performed in the address period of the data erasure period of the first sub-frame. In the sixth embodiment, the back-light 22 is turned on at least during the entire period of the data write period and the address period of the data erasure period within the first sub-frame. In contrast, in the seventh embodiment, the back-light 22 is turned on only in the retention period of the data write period of the first sub-frame to display the written data. According to such a drive sequence, it is possible to improve the image quality to the same extent as in the fourth embodiment or achieve a further improvement.

Besides, in this seventh embodiment, like the above-described another example and still another example of the sixth embodiment, it is possible to implement a drive sequence in which the succeeding half of the first sub-frame is designated as the data write period and the leading half of the second sub-frame is designated as the data erasure period, or a drive sequence in which the leading half of the second sub-frame is designated as the data write period and the succeeding half of the second sub-frame is designated as the data erasure period.

(Eighth Embodiment)

Figure 23:
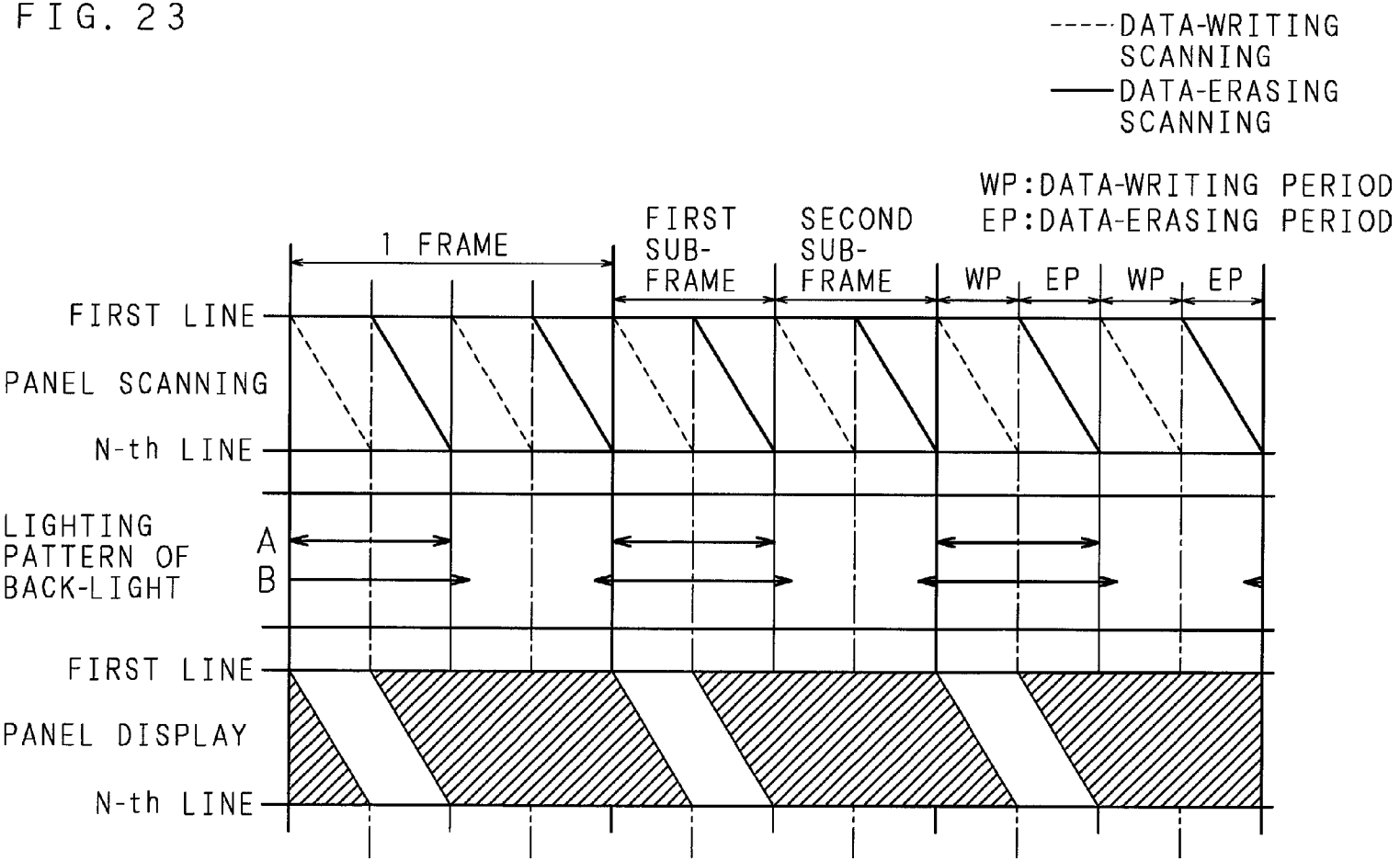
FIG. 23 is an illustration showing a drive sequence according to one example of the eighth embodiment.

FIG. 23 is an illustration showing a drive sequence according to one example of the eighth embodiment. In the eighth embodiment, one frame is divided into two sub-frames, namely the first sub-frame and the second sub-frame, and each of the first and second sub-frames is further divided into two halves: a leading data write period and a succeeding data erasure period. Data writing is executed in the respective data write periods of the first and second sub-frames, and data erasure (i.e., black display) is performed in the respective data erasure periods of the first and second sub-frames. Within each sub-frame, data erasure is started immediately after the completion of data writing. The exactly identical data are inputted to the liquid crystal panel 21 in the first sub-frame and second sub-frames.

Lighting patterns of the back-light 22 may include: a mode (mode A) in which the back-light 22 is in the "ON" state in the first sub-frame; and a mode (mode B) in which the back-light 22 is turned on at a given first timing within the second sub-frame immediately before the start of the first sub-frame, kept in the "ON" state during the entire period of the first sub-frame, and continues to be in the "ON" state until a given second timing within the second sub-frame immediately after the end of the first sub-frame. According to such a drive sequence, an advantageous effect equivalent to that of the fifth embodiment is produced.

Figure 24:
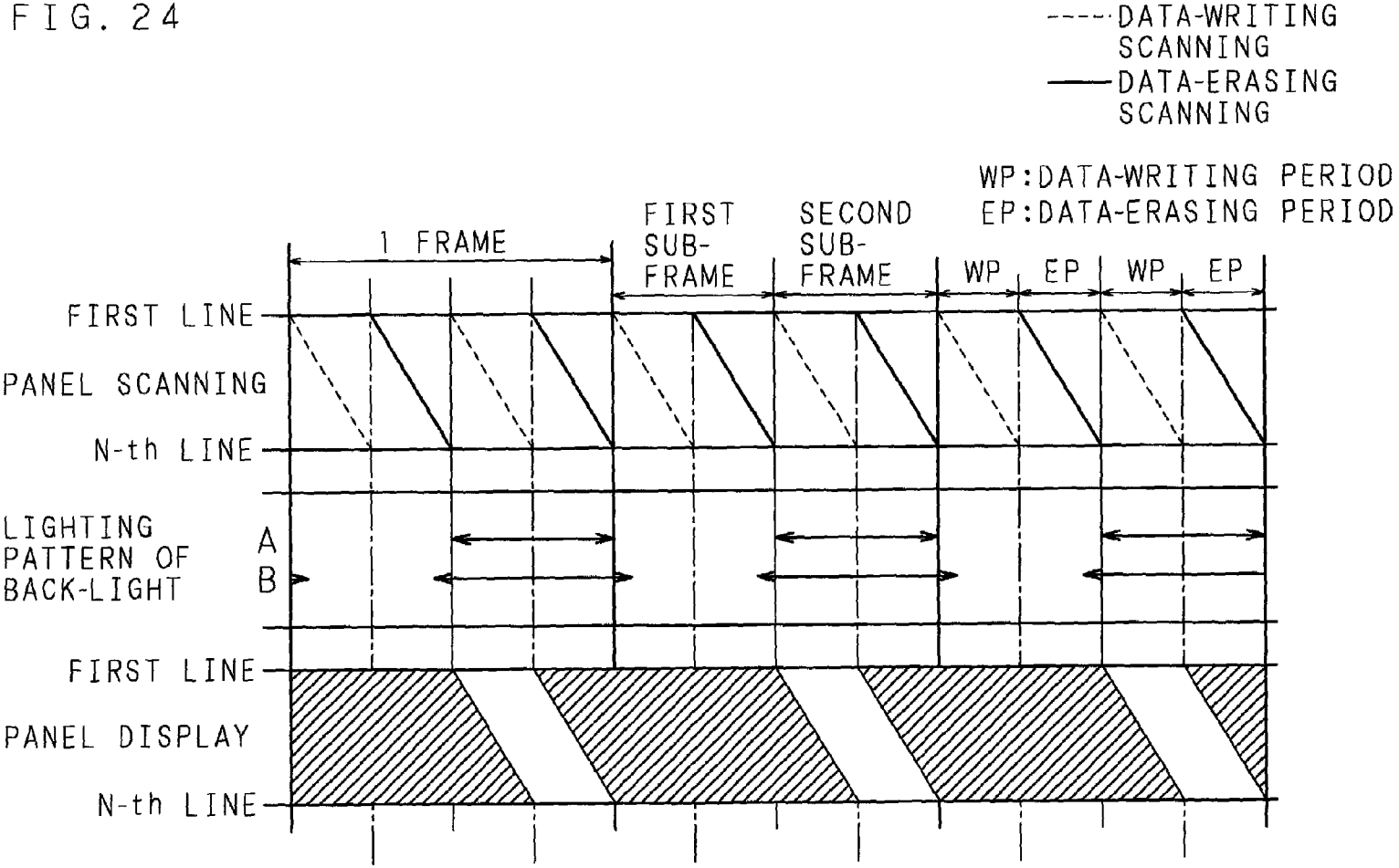
FIG. 24 is an illustration showing a drive sequence according to another example of the eighth embodiment.

FIG. 24 is an illustration showing a drive sequence according to another example of the eighth embodiment. In this example, the data writing process and data erasing process are the same as those of the above example. However, the back-light 22 is turned on mainly in the second sub-frame.

Figure 25:
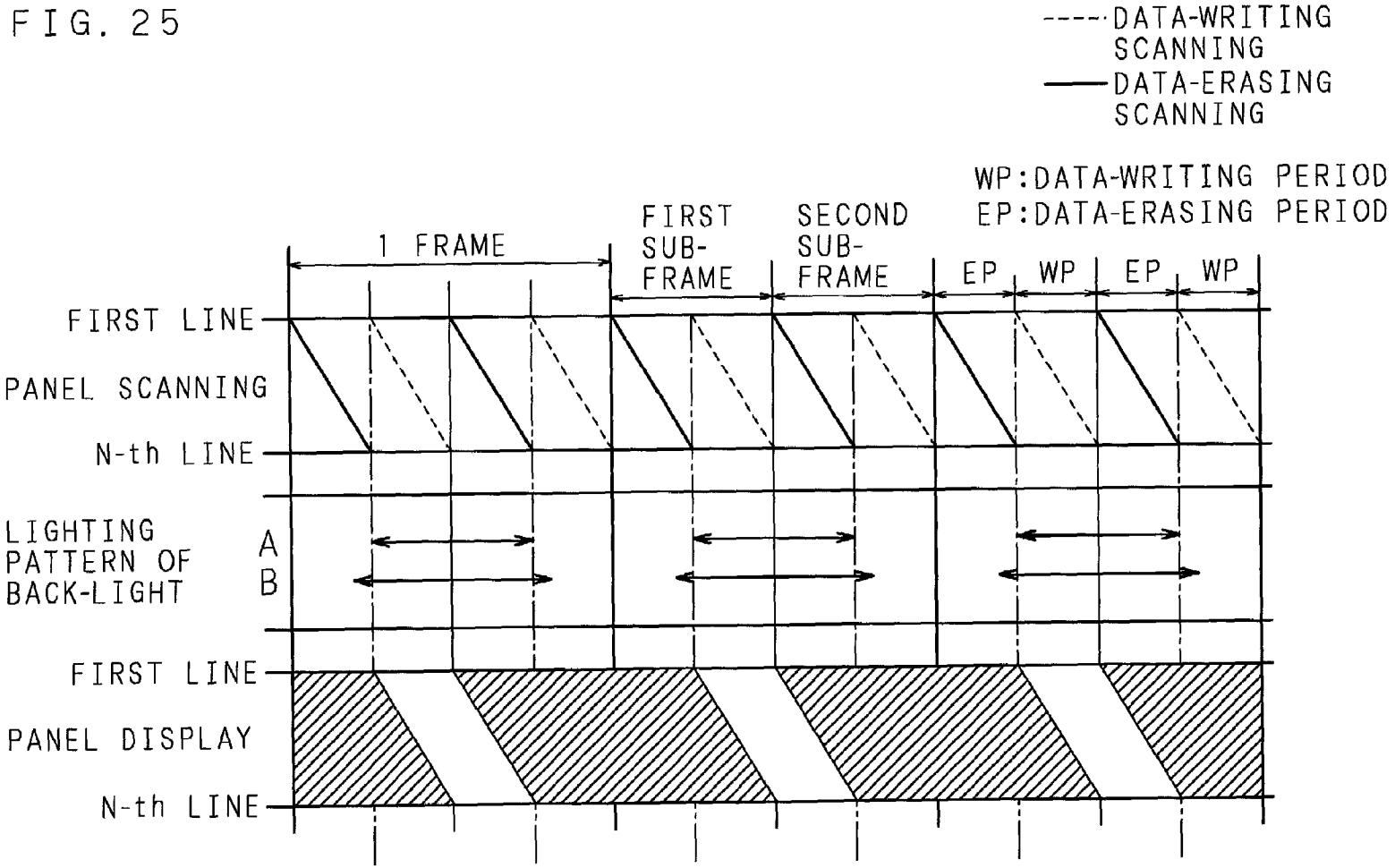
FIG. 25 is an illustration showing a drive sequence according to still another example of the eighth embodiment.

FIG. 25 is an illustration showing a drive sequence according to still another example of the eighth embodiment. In this example, the leading half of each of the first and second sub-frames is designated as the data erasure period, the succeeding half thereof is designated as the data write period, and the back-light 22 is turned on mainly in the succeeding data write period of the first sub-frame and the leading data erasure period of the second sub-frame.

In the eighth embodiment as described above, since the back-light 22 is controlled to be turned on by periodically repeating the data writing process and data erasing process so that data erasure is started upon the completion of data writing, it is extremely easy to control data writing and data erasure with respect to the liquid crystal panel 21.

(Ninth Embodiment)

Figure 26:
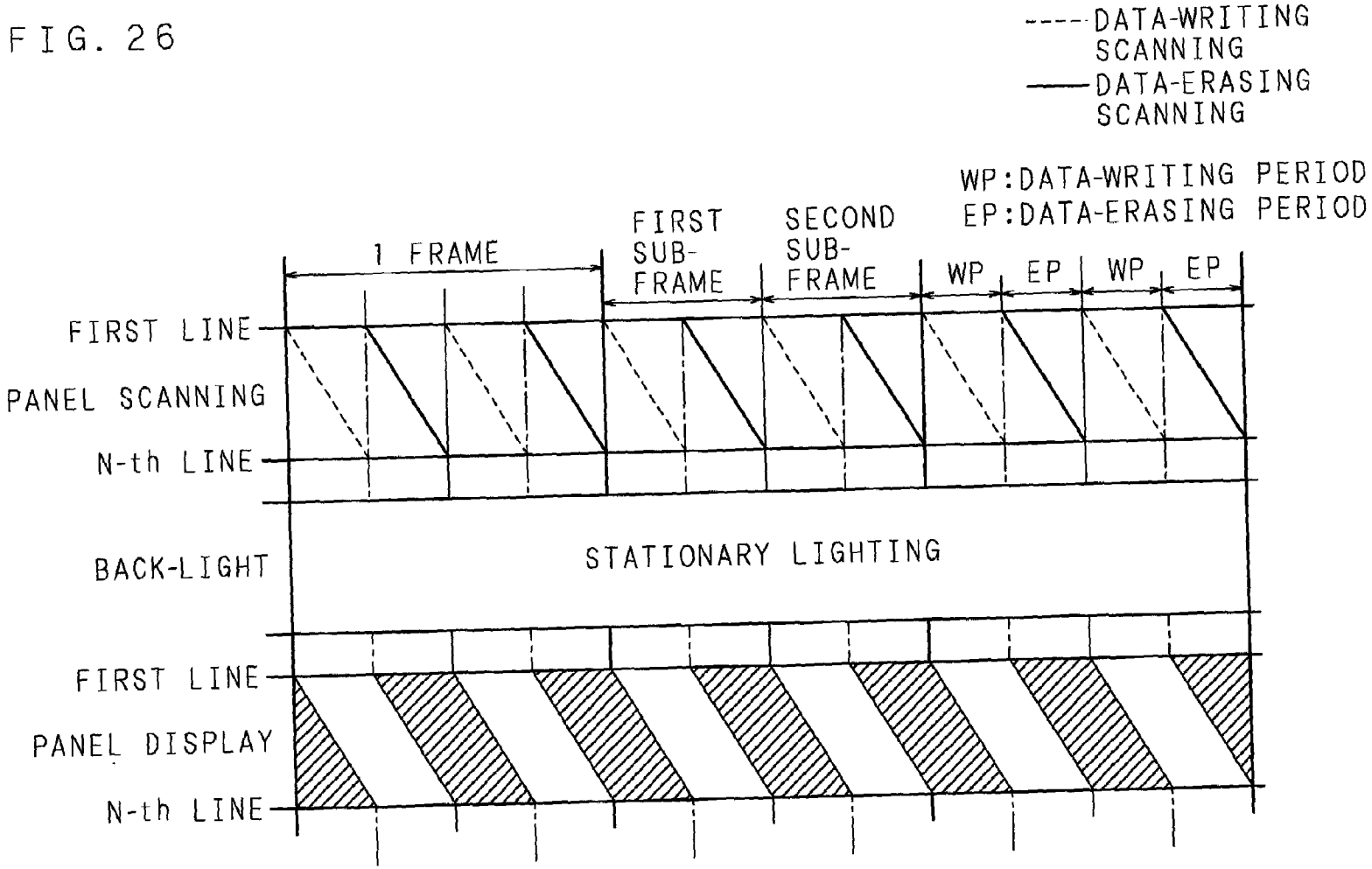
FIG. 26 is an illustration showing a drive sequence according to one example of the ninth embodiment.

FIG. 26 is an illustration showing a drive sequence according to one example of the ninth embodiment. The data writing process and data erasing process in the ninth embodiment are the same as those in the above-described eighth embodiment. Accordingly, data writing is performed in the respective data write periods of the first and second sub-frames, and data erasure is executed in the respective data erasure periods of the first and second sub-frames. In the eighth embodiment, the back-light 22 is in the "ON" state over a set of the data write period and data erasure period. In contrast, in the ninth embodiment, the back-light 22 is always in the "ON" state so as to display the same pixel twice within one frame. According to such a drive sequence, it is possible to produce an advantageous effect equivalent to that of the fifth embodiment.

Figure 27:
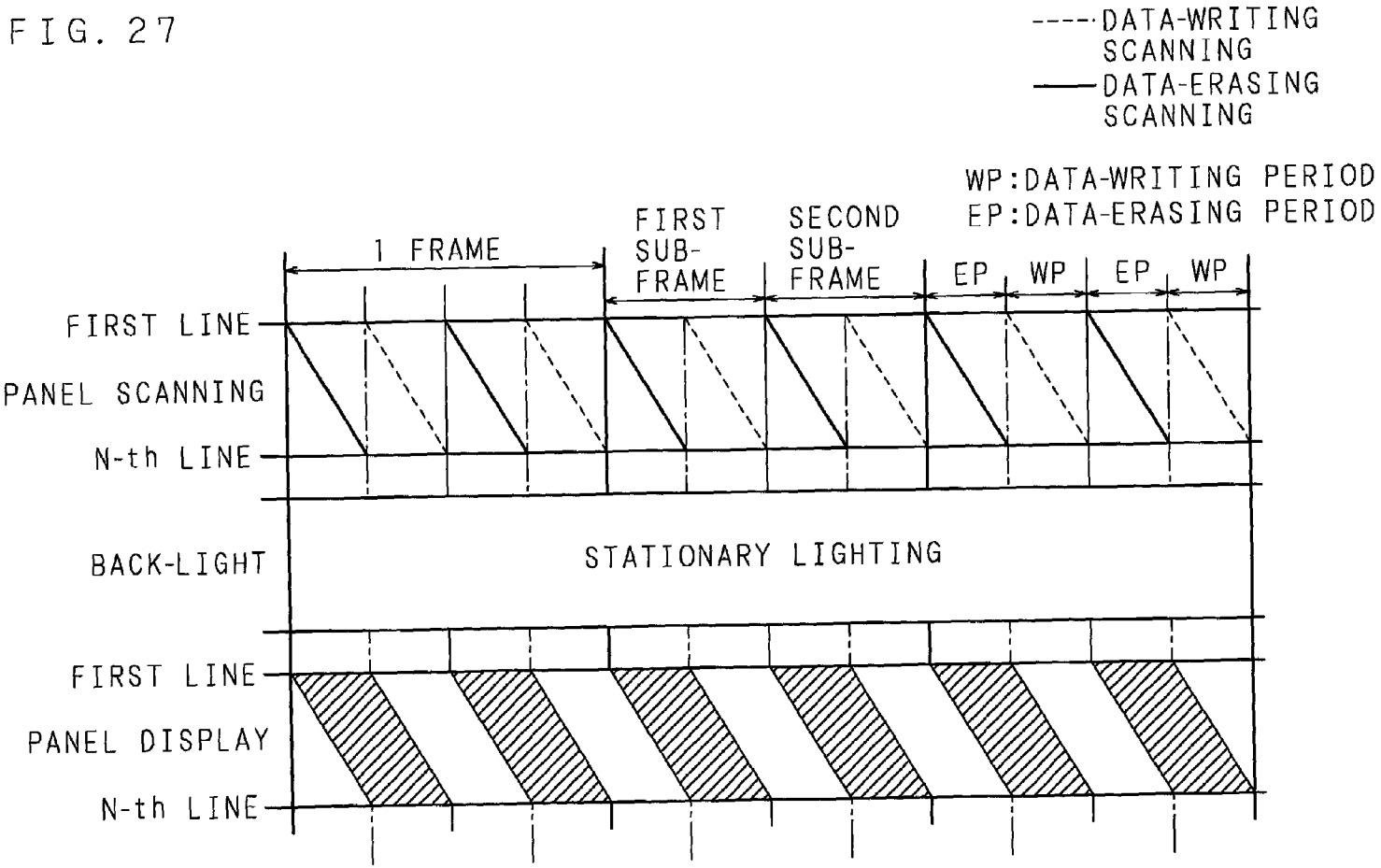
FIG. 27 is an illustration showing a drive sequence according to another example of the ninth embodiment.

FIG. 27 is an illustration showing a drive sequence according to another example of the ninth embodiment. In this example, the leading half of each of the first and second sub-frames is designated as the data erasure period, the succeeding half thereof is designated as the data write period, and the back-light 22 is always in the "ON" state.

(Tenth Embodiment)

Figure 28:
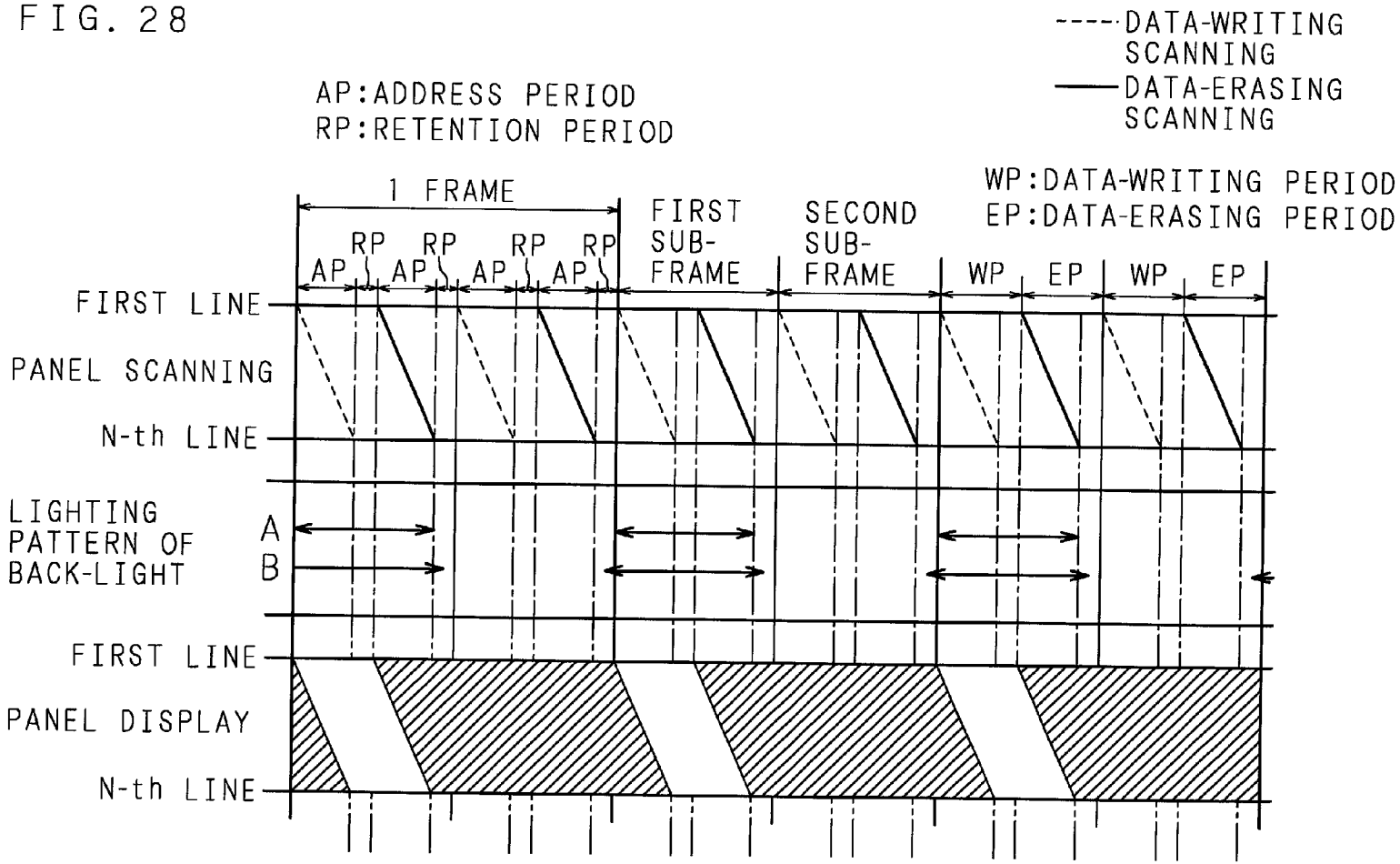
FIG. 28 is an illustration showing a drive sequence according to one example of the tenth embodiment.

FIG. 28 is an illustration showing a drive sequence according to one example of the tenth embodiment. In the tenth embodiment, one frame is divided into two sub-frames, namely the first sub-frame and the second sub-frame, and each of the first and second sub-frames is further divided into two halves: a leading data write period and a succeeding data erasure period. In addition, each of the data write period and data erasure period is divided into a leading part and a succeeding part, namely the address period and the retention period. Then, data writing is executed in the address period of the data write period of each of the first and second sub-frames, and data erasure (i.e., black display) is performed in the address period of the data erasure period of each of the first and second sub-frames. Within each sub-frame, data writing is executed during the address period of the data write period, the data retention period starts after the completion of data writing, and then data erasure is carried out during the address period of the data erasure period. The exactly identical data are inputted to liquid crystal panel 21 in the first and second sub-frames.

Lighting patterns of the back-light 22 may include: a mode (mode A) in which the back-light 22 is in the "ON" state during the entire period of the data write period and the address period of the data erasure period within the first sub-frame; and a mode (mode B) in which the back light 22 is turned on at a given first timing within the second sub-frame immediately before the start of the first sub-frame and continues to be in the "ON" state until a given second timing within the retention period of the data erasure period of the first sub-frame. According to such a drive sequence, it is possible to produce an advantageous effect equivalent to that of the fifth embodiment.

Figure 29:
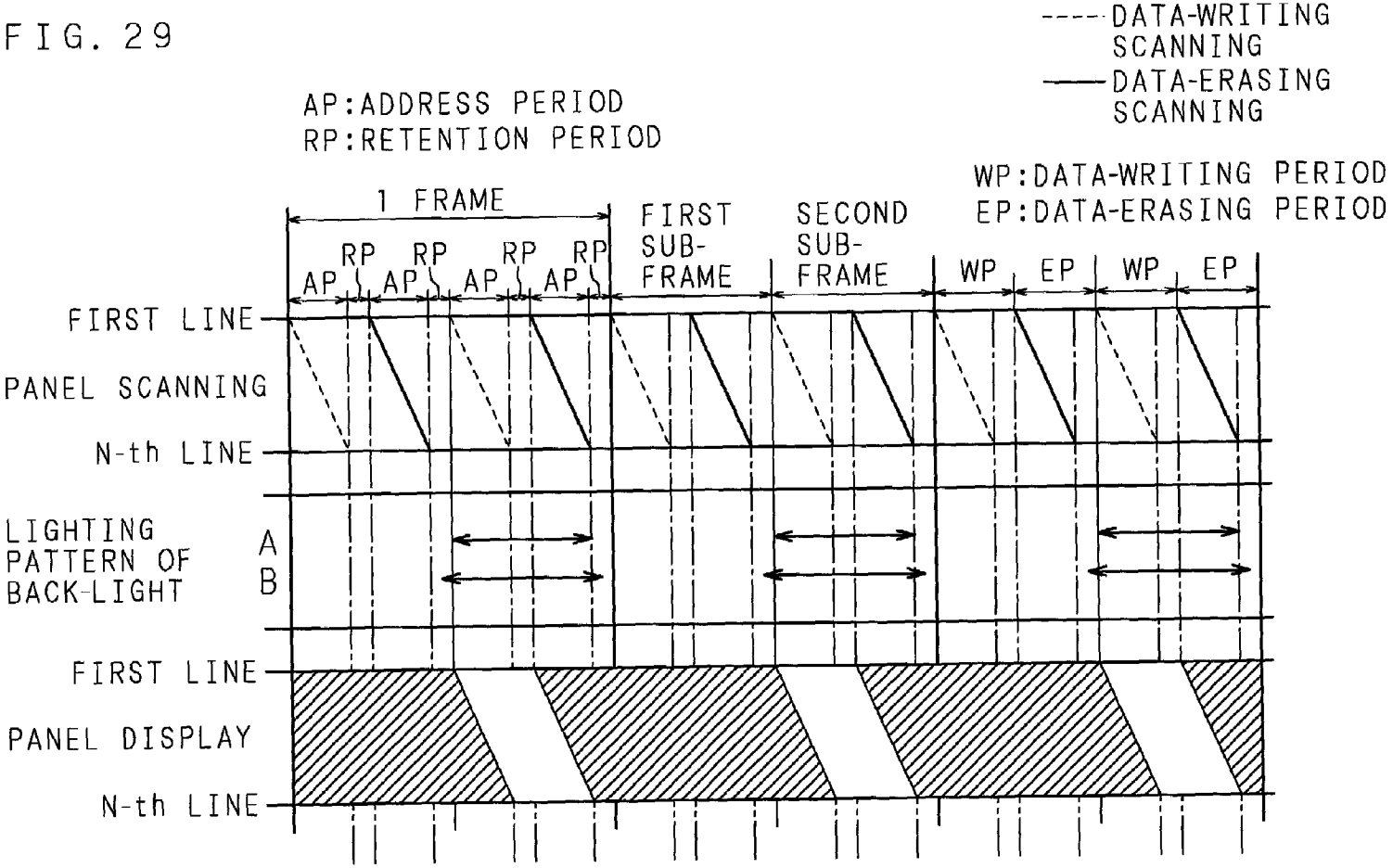
FIG. 29 is an illustration showing a drive sequence according to another example of the tenth embodiment.

FIG. 29 is an illustration showing a drive sequence according to another example of the tenth embodiment. In this example, the data writing process and data erasing process are the same as those in the above example, but the back-light 22 is turned on during the entire period of the data write period and mainly in the address period of the data erasure period within the second sub-frame.

Figure 30:
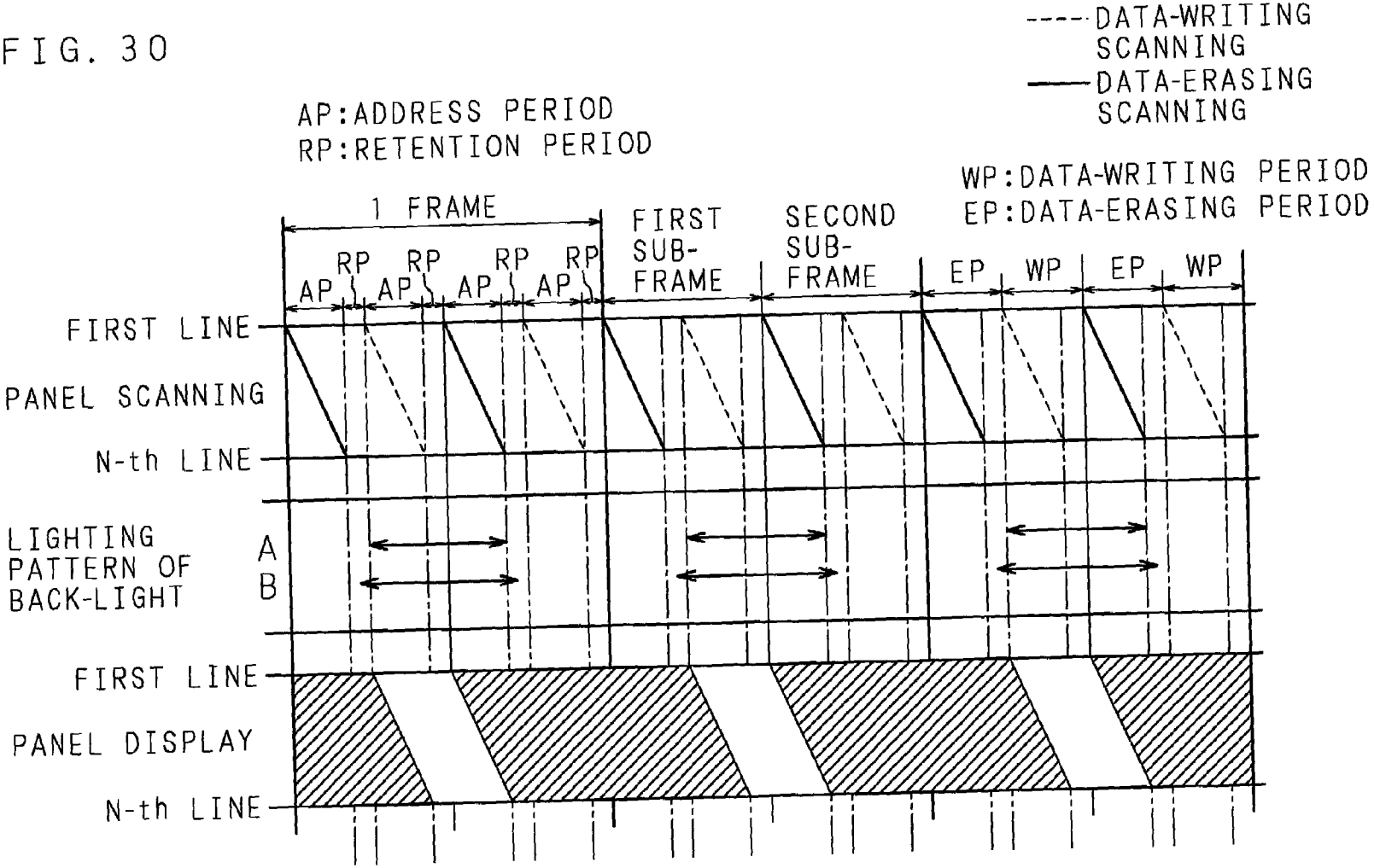
FIG. 30 is an illustration showing a drive sequence according to still another example of the tenth embodiment.

FIG. 30 is an illustration showing a drive sequence according to still another example of the tenth embodiment. In this example, the leading half of each of the first and second sub-frames is designated as the data erasure period, the succeeding half thereof is designated as the data write period, and the back-light 22 is turned on mainly in the succeeding data write period of the first sub-frame and the leading data erasure period of the second sub-frame.

Figure 31:
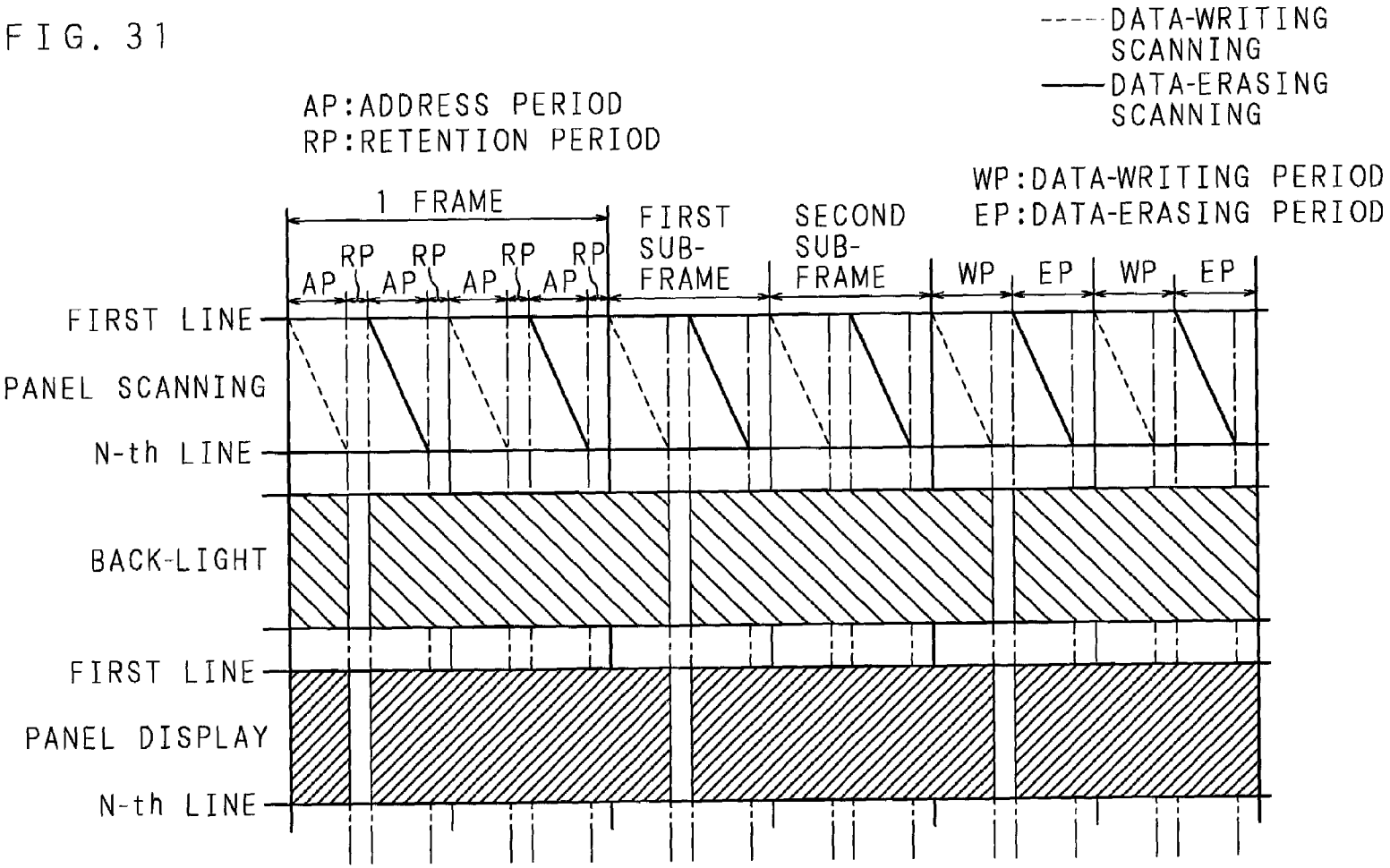
FIG. 31 is an illustration showing a drive sequence according to still another example of the tenth embodiment.

FIG. 31 is an illustration showing a drive sequence according to still another example of the tenth embodiment. In this example, the back-light 22 is turned on only within the retention period of the leading data write period of the first sub-frame.

Figure 32:
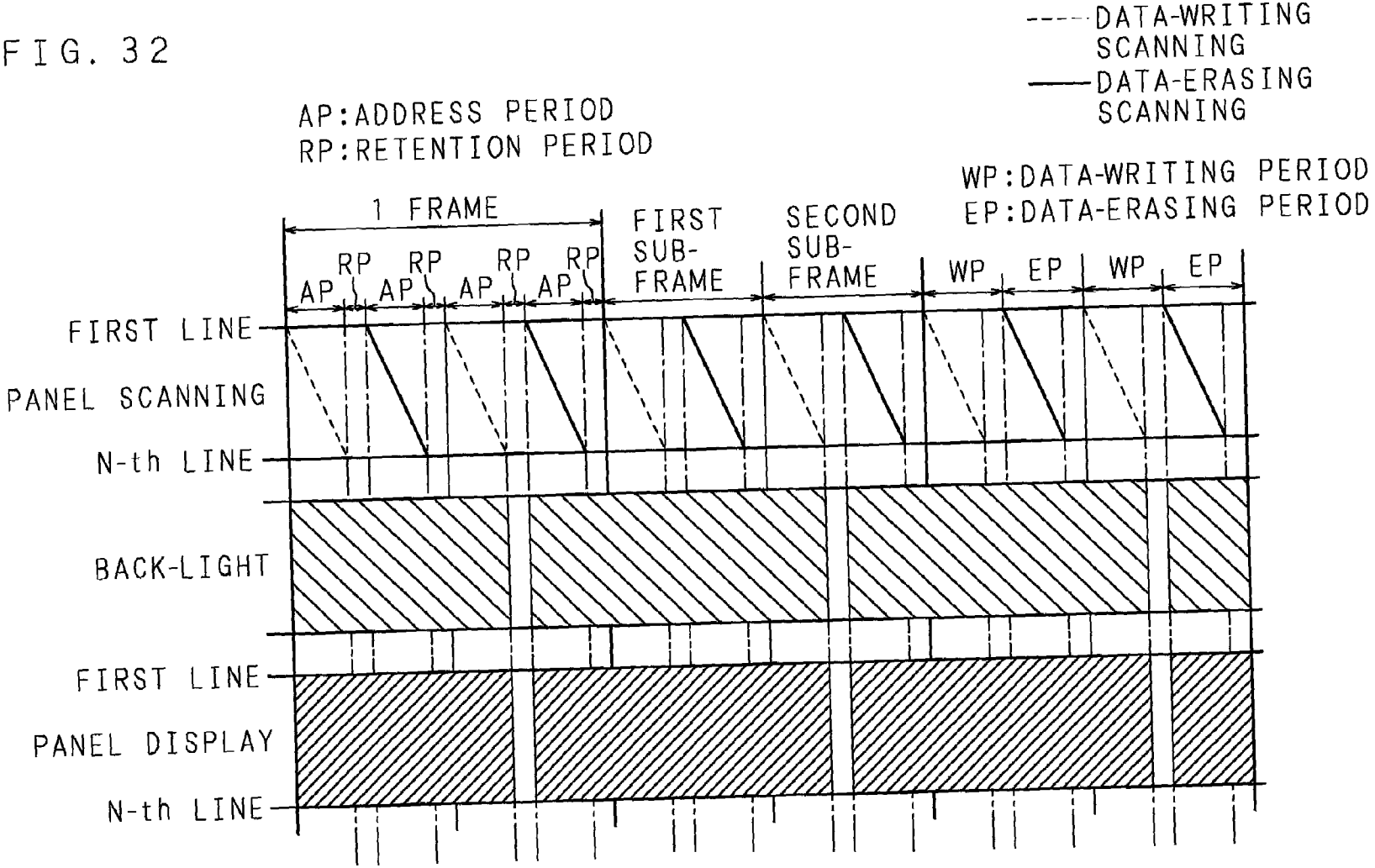
FIG. 32 is an illustration showing a drive sequence according to still another example of the tenth embodiment.

FIG. 32 is an illustration showing a drive sequence according to still another example of the tenth embodiment. In this example, the back-light 22 is turned on only within the retention period in the leading data write period of the second sub-frame.

Figure 33:
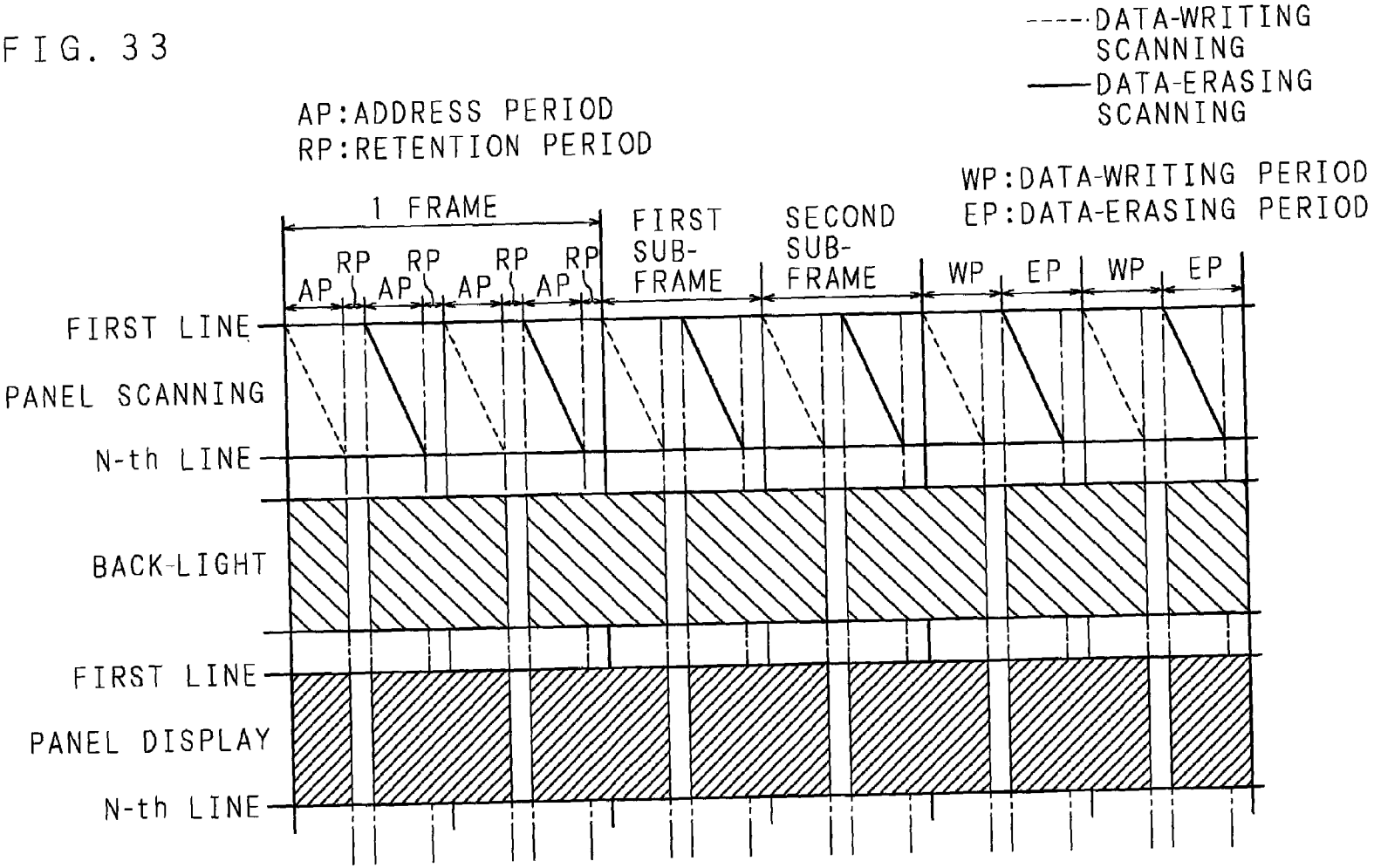
FIG. 33 is an illustration showing a drive sequence according to still another example of the tenth embodiment.

FIG. 33 is an illustration showing a drive sequence according to still another example of the tenth embodiment. In this example, the back-light 22 is turned on only within the retention period in the leading data write period of each of the first and second sub-frames.

Figure 34:
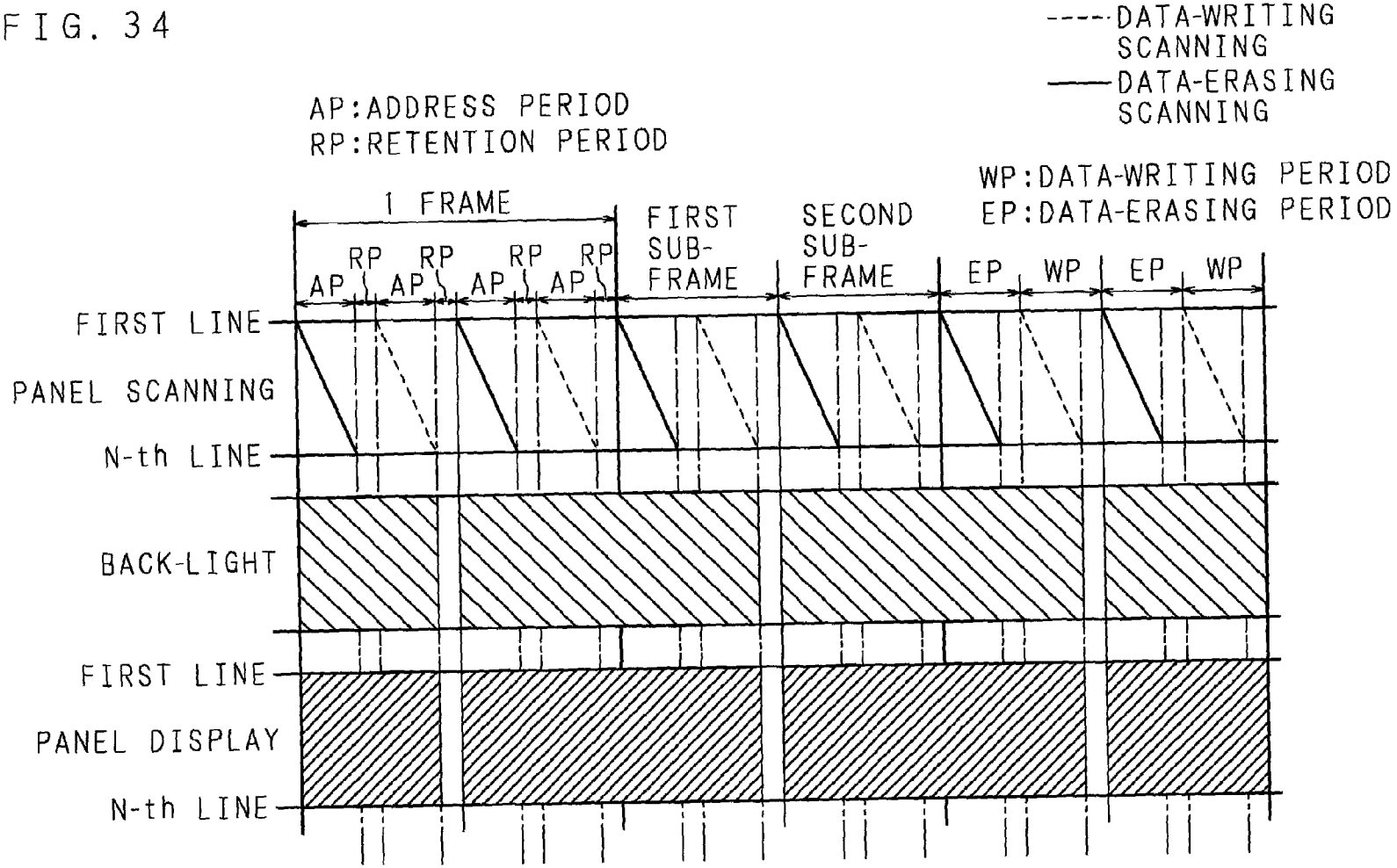
FIG. 34 is an illustration showing a drive sequence according to still another example of the tenth embodiment.

FIG. 34 is an illustration showing a drive sequence according to still another example of the tenth embodiment. In this example, the leading half of each sub-frame is designated as the data erasure period, the succeeding half thereof is designated as the data write period, and the back-light 22 is turned on only within the retention period in the succeeding data write period of the first sub-frame.

Figure 35:
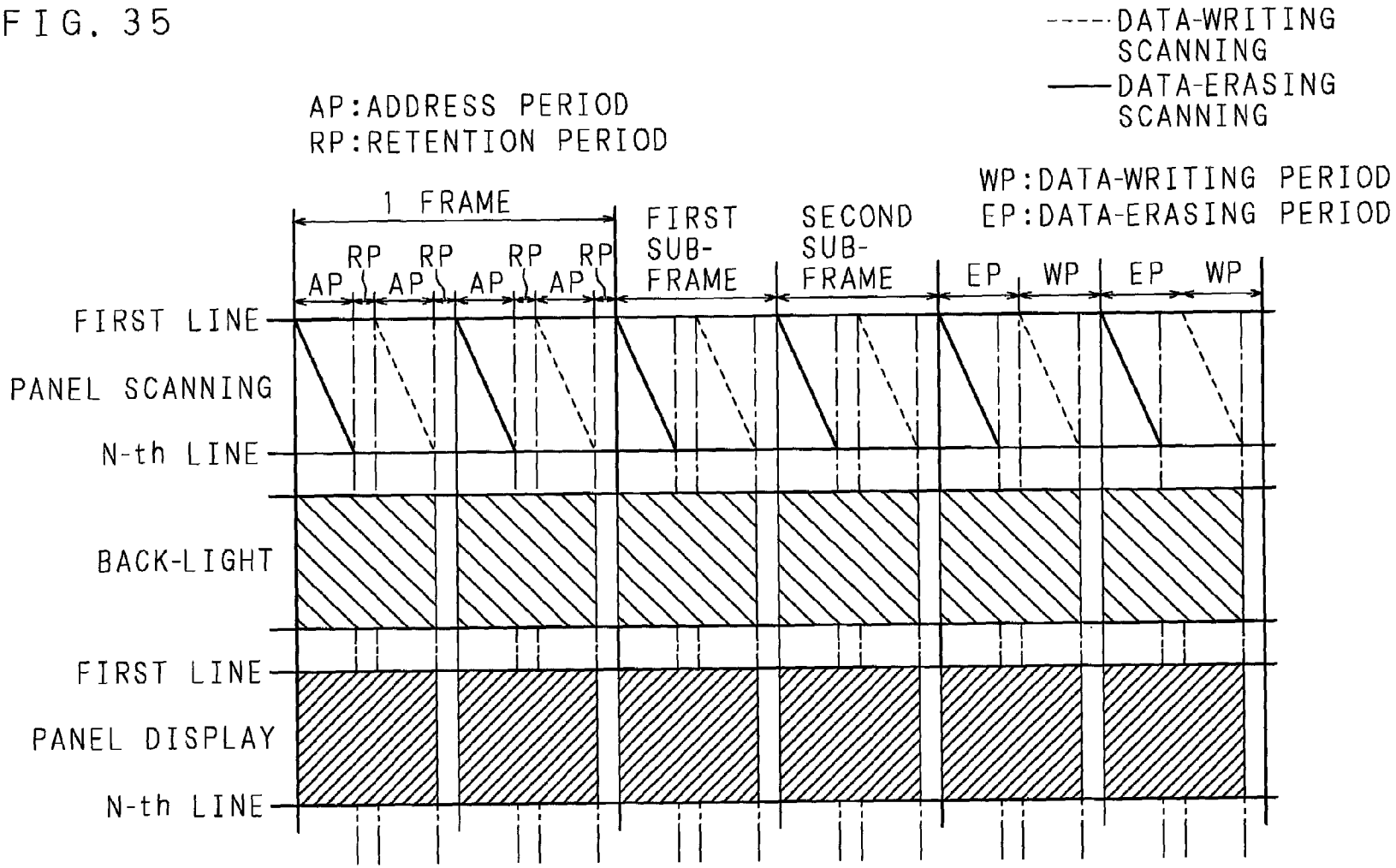
FIG. 35 is an illustration showing a drive sequence according to still another example of the tenth embodiment.

FIG. 35 is an illustration showing a drive sequence according to still another example of the tenth embodiment. In this example, the leading half of each sub-frame is designated as the data erasure period, the succeeding half thereof is designated as the data write period, and the back-light 22 is turned on only within the retention period in the succeeding data write period of each of the first and second sub-frames.

(Eleventh Embodiment)

Figure 36:
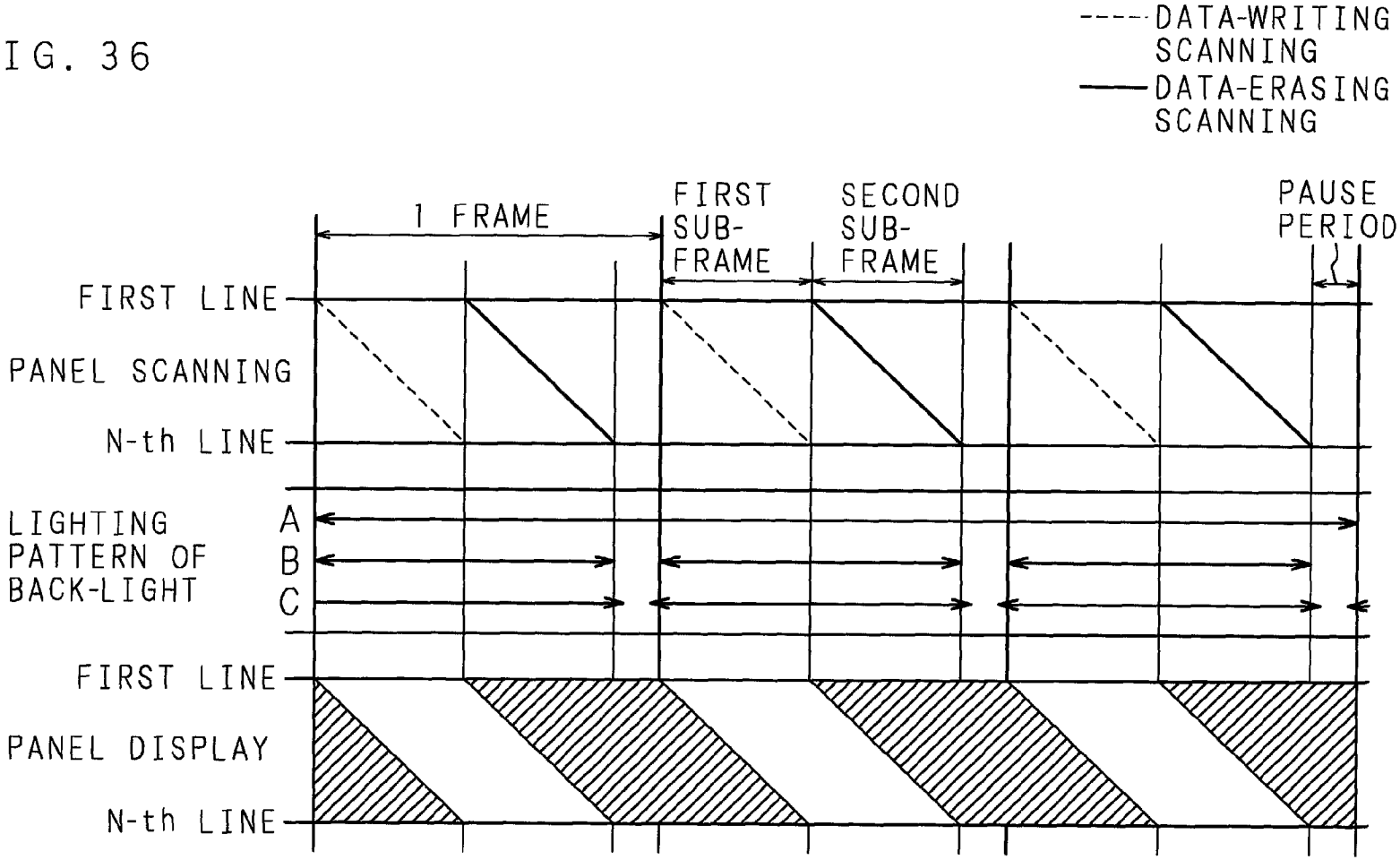
FIG. 36 is an illustration showing a drive sequence according to the eleventh embodiment.

FIG. 36 is an illustration showing a drive sequence according to the eleventh embodiment. In the eleventh embodiment, one frame is divided into a first sub-frame, a second sub-frame and a suspension period. In this case, data writing is executed in the first sub-frame, and data erasure (i.e., black display) is performed in the second sub-frame.

Lighting patterns of the back-light 22 may include: a mode (mode A) in which the back-light 22 is in the "ON" state during the entire period; a mode (mode B) in which the back-light 22 is in the "ON" state during the first and second sub-frames and in the "OFF" state during the suspension period; and a mode (mode C) in which the back-light 22 is turned on at a given first timing within the suspension period immediately before the start of the first sub-frame, kept in the "ON" state during the entire period of the first and second sub-frames, and continues to be in the "ON" state until a given second timing within the suspension period immediately after the end of the second sub-frame. According to such a drive sequence, it is possible to obtain a more improved image compared with the first embodiment.

Besides, as another example of this eleventh embodiment, needless to say, it is possible to implement a drive sequence by combining such a suspension period with the above-described second through tenth embodiments.

(Twelfth Embodiment)

Figure 37:
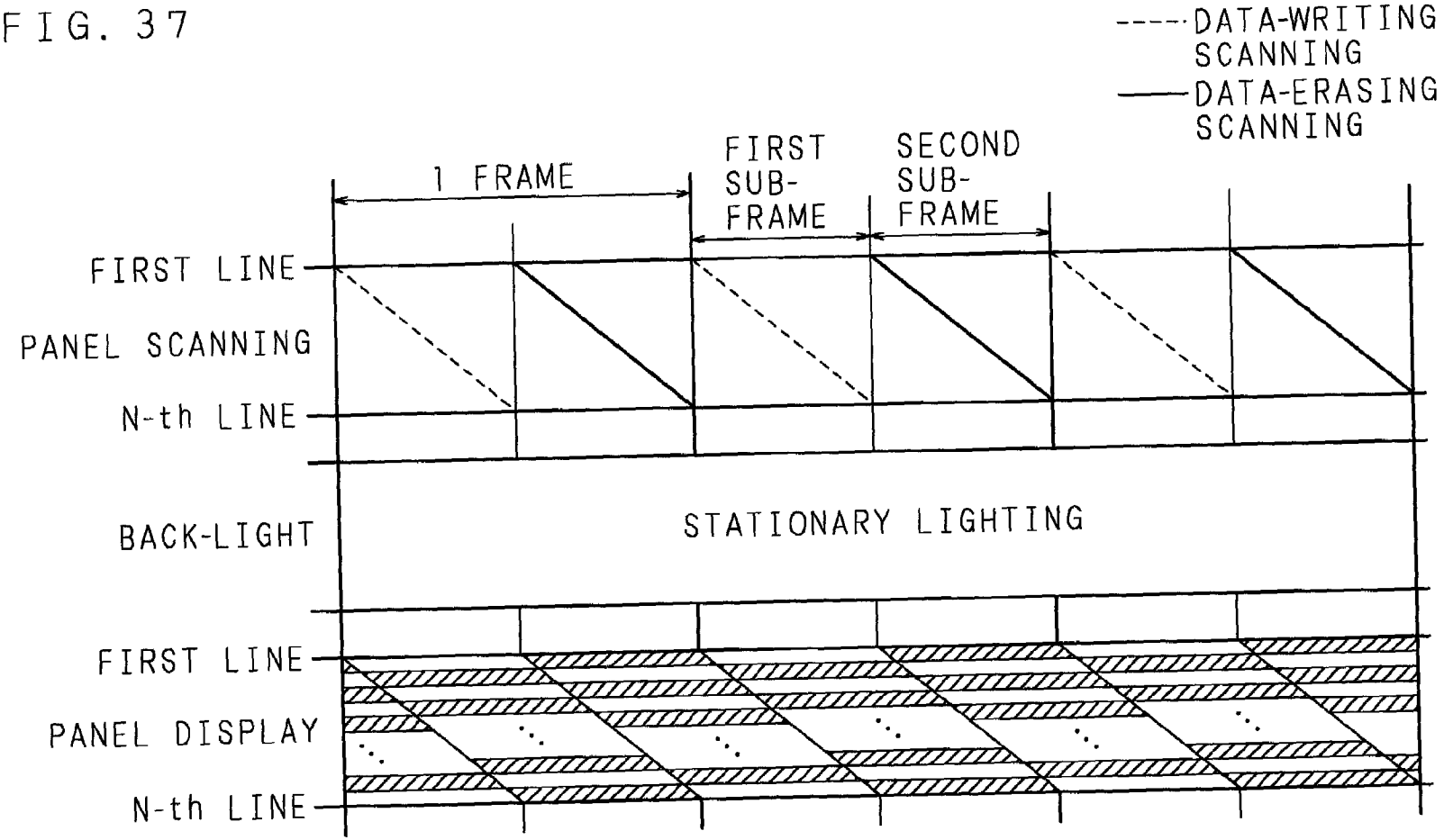
FIG. 37 is an illustration showing a drive sequence according to one example of the twelfth embodiment.

FIG. 37 is an illustration showing a drive sequence according to the twelfth embodiment. In the twelfth embodiment, one frame is divided into two sub-frames, namely the first sub-frame and the second sub-frame. Then, driving (dot inversion driving) in which the adjacent electrodes of the data electrodes have opposite polarities is executed so that data erasure is executed in the second sub-frame when data writing is performed in the first sub-frame; or data writing is carried out in the second sub-frame when data erasure is performed in the first sub-frame. The back-light 22 is always in the "ON" state.

Figure 38:
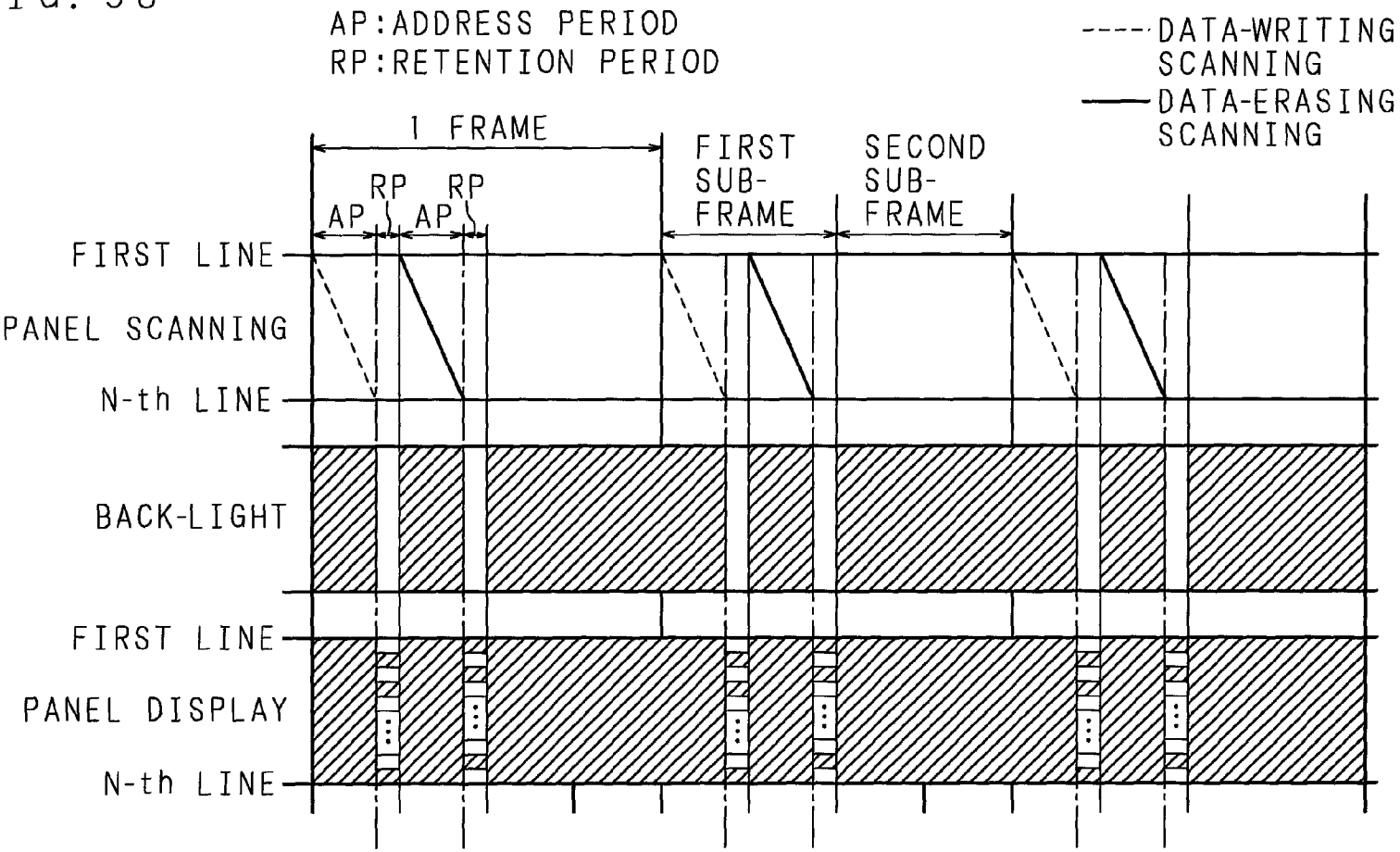
FIG. 38 is an illustration showing a drive sequence according to another example of the twelfth embodiment.

Besides, as another example of this twelfth embodiment, needless to say, it is possible to implement a drive sequence by combining such dot inversion driving with the above-described second through eleventh embodiments. FIG. 38 is an illustration showing a drive sequence according to another example of the twelfth embodiment. In this example, like the seventh embodiment, data writing is performed in the address period of the data write period of the first sub-frame, data erasure is executed in the address period of the data erasure period of the first sub-frame, and the back-light 22 is turned on only in the respective retention periods of the data write period and data erasure period of the first sub-frame.

In the twelfth embodiment as described above, since dot inversion driving is performed, a dot inversion driver may be used.

(Thirteenth Embodiment)

In each of the above-described embodiments, while the data write period and data erasure period are arranged to have the same duration, they may have different duration. In the case where the respective periods are set to different duration, when the maximum voltage to be applied to the liquid crystal material is denoted by $V_{max}$ and the duration of the period at that time is represented by t, it is effective to use a drive sequence which adjusts the applied voltage and the duration of period to satisfy equation (1).

$$V\max \times t = \text{constant} \quad (1)$$

As described in detail above, in the liquid crystal display device of the present invention, the frequency in the data writing process for the active matrix panel is made at least twice the frame frequency and the data writing process and the data erasing process with respect to the active matrix panel are completed within one frame time so that time taken for transmission of light through the coloring member such as a color filter is not more than a half of one frame time. It is therefore possible to reduce the degradation of the image quality of the outline portion resulting from display of a full moving image, and to provide a display that can be used as a multimedia display.

Moreover, in the liquid crystal display device of the present invention, since the data writing process and the data erasing process are performed using the entire period in one frame time, it is possible to readily control the data writing process and the data erasing process.

Furthermore, in the liquid crystal display device of the present invention, since neither the data writing process nor the data erasing process is performed during a certain period within one frame time, it is possible to further reduce time taken for transmission of light through the coloring member such as a color filter and to further reduce the degradation of the image quality, thereby achieving a further improvement in the image quality.

Additionally, in the liquid crystal display device of the present invention, since the back-light as a light source is controlled to be turned on or off according to the data writing process and the data erasing process, it is possible to turn on the back-light only in a necessary period, thereby achieving a reduction in the power consumption.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A liquid crystal display device comprising:

an active matrix panel having a coloring member;

a liquid crystal having spontaneous polarization, sealed in said active matrix panel; and a writing/erasing unit for displaying an image on a frame by frame basis by repeating a data writing process and a data erasing process for said active matrix panel;

wherein one frame time comprises a period of the data writing process, a period of the data erasing process and a period during which neither the data writing process nor the data erasing process is performed, and the liquid crystal display device further comprising:

a back-light for irradiating white light on said coloring member; and a back-light controller for controlling said back-light to be turned on or off according to the period of the data writing process, the period of the data erasing process, and the period during which neither the data writing process nor the data erasing process is performed.

2. A liquid crystal display method using a liquid crystal display device constructed by sealing a liquid crystal having spontaneous polarization in an active matrix panel including a coloring member;

wherein an image is displayed on a frame by frame basis by repeating a data writing process and a data erasing process for the active matrix panel;

one frame time comprises a period of the writing process, a period of the data erasing process and a period during which neither the data writing process nor the data erasing process is performed; and white light is irradiated on the coloring member, and irradiation/non-irradiation of the white light is controlled according to the period of the data writing process, the period of the data erasing process and the period during which neither the data writing process nor the data erasing process is performed.

* * * * *